US005299397A

United States Patent [19]

Ahern

[11] Patent Number: 5,299,397

[45] Date of Patent: Apr. 5, 1994

[54] FRANGIBLE ENCLOSURE WITH LOW RESISTANCE TO IMPACT

[75] Inventor: William W. Ahern, Belmont, Mass.

[73] Assignee: Electronic Space Systems Corporation, Concord, Mass.

[21] Appl. No.: 681,572

[22] Filed: Apr. 5, 1991

[51] Int. Cl.[5] ..... E04B 1/00

[52] U.S. Cl. ..... 52/98; 52/1; 52/80.1; 52/123.1

[58] Field of Search ..... 52/98, 110, 80, 192, 52/194, 99, 100, 84, 309.4, 309.7, 309.8, 309.9, 73, 1, 123.1, 79.5

[56] References Cited

U.S. PATENT DOCUMENTS

| | | | |
|---|---|---|---|
| 2,923,305 | 2/1960 | Cline | 52/1 X |
| 3,285,644 | 11/1966 | Tomek | 52/98 |
| 3,319,520 | 5/1967 | Stefano et al. | 52/98 X |
| 4,112,634 | 9/1978 | Bissinger | 52/194 X |
| 4,196,550 | 4/1980 | Svensson | 52/98 |
| 4,498,261 | 2/1985 | Wilson et al. | 52/1 |
| 4,513,196 | 4/1985 | Bartelsen | 52/171 X |
| 4,653,238 | 3/1987 | Berman | 52/79.4 |
| 4,774,119 | 9/1988 | Imhoff | 52/309.7 X |
| 4,795,666 | 1/1989 | Okada et al. | 52/309.4 X |
| 4,805,356 | 2/1989 | Feisst | 52/71 |
| 4,848,046 | 7/1989 | Wallhead | 52/84 X |

*Primary Examiner*—Carl D. Friedman
*Assistant Examiner*—Kien Nguyen
*Attorney, Agent, or Firm*—Wolf, Greenfield & Sacks

[57] ABSTRACT

A frangible enclosure with low resistance to impact has a curvature such that a distributed load primarily is resisted by axial stresses generated therein, in little or no bending stresses are generated. Weakened portions are made in the enclosure which reduce the flexural strength of the enclosure. The enclosure is made of a plurality of panels, which panels are constructed of a composite laminate of fiber reinforced material. The panels are interconnected to form a housing, or enclosure. Weakened portions in the panel can be made by perforating or cutting the material of which the laminate is made. A floor system can also be provided for an enclosure. Such a floor system, which is also frangible, is made of a support frame upon which the floor panels rest and loosely engage. The floor support frame can be supported by the base of the enclosure, or other supporting objects in the enclosure. If the enclosure is used for an antenna, it also incorporates an ice prevention system having a plurality of frangible wires. An enclosure with such a construction will be able to withstand large distributed loads but break apart upon impact into pieces having a maximum dimension of at most a fixed size.

13 Claims, 22 Drawing Sheets

FRANGIBLE ENCLOSURE WITH LOW RESISTANCE TO IMPACT

RELATED APPLICATIONS

The following two patent applications are closely related hereto:

1. "Frangible Panel for a Frangible Enclosure with Low Resistance to Impact," U.S. patent application Ser. No. 07/681,569, filed Apr. 5, 1991, in the name of William Ahern; and 2. "Floor System with Low Resistance to Impact," U.S. patent application Ser. No. 07/681,570, filed Apr. 5, 1991, also in the name of William Ahern;

Both of their disclosures are hereby incorporated by reference.

FIELD OF THE INVENTION

This invention concerns a frangible enclosure, for housing an antenna or other use, which has low resistance to localized impact while having high resistance to strong distributed loads such as wind loads.

BACKGROUND OF THE INVENTION

The Federal Aviation Administration (FAA) of the U.S. Government and other bodies have requested designs for enclosures for various types of antennas to be used at airports. An important requirement for these enclosures is the ability to withstand repeated jet blasts of 150 m.p.h. from aircraft and sustained winds. A jet blast may have a duration of up to one minute, may be from an angle up to 15° from horizontal and may occur up too 500 times per month. However the enclosure must shatter on impact by a colliding light aircraft traveling at about 75 m.p.h. Moreover, only minimum damage upon the aircraft can be inflicted. To this end, upon impact the enclosure must shatter into small pieces e.g., pieces having a maximum span of at most four feet. These criteria result from a plan to construct antenna towers and other structures very close to and along airport runways, such as for use with improved instrument landing systems. The location of these structures necessitates the frangibility of the enclosures. I am currently unaware of any enclosures which are specifically designed to be frangible and to shatter upon impact yet withstand large distributed loads.

A radar antenna in such an enclosure must be accessible by installers and maintenance personnel, thus, a floor system is required therein to allow personnel to work inside the enclosure. Such a floor system needs to support primarily vertical loads of personnel and equipment but also needs to break up easily into separate parts when subjected to impact loads from a collision. These impact loads normally involve large horizontally directed forces. A typical load of personnel and equipment on a floor which must be supported by the floor system is about 100 pounds per square foot in the vertical direction. A substantially horizontal impact load of 700 ft./lbs. per breakage area must also cause failure of the floor system.

An access door is also needed in the enclosure to permit personnel access. Such doors need to be designed so that the frangibility of the enclosure is not compromised. Furthermore, a door should cause minimal interruption of the enclosure surface.

In an enclosure for an antenna, the antenna window must also incorporate an anti-icing system because ice absorbs radar signals. Such a system uses heating wires for which the size, material and spacing need to be selected in order to ensure proper antenna performance and anti icing without compromising the frangibility of the enclosure.

Typical antenna and building enclosures for airport use are made of a plurality of panels or other structional elements which are attached together to form a housing. However, there are currently no panels or housing construction designed to fail in a manner as described above.

The details of the enclosure design were not addressed by the request from the FAA. The design of an adequate frangible enclosure needed to consider the shape of the enclosure so that drag forces could be reduced by minimizing its size, configuration, the materials of construction, and the effect of the construction on antenna performance.

Accordingly, it is an object of the present invention to provide a frangible enclosure, for housing an antenna or other use, with low resistance to localized impact, but having high resistance to distributed loads, such as those from wind.

More particularly, it is an object of the invention to provide an enclosure that will withstand repeated jet blasts from large aircraft, but shatter on impact from a colliding light aircraft, while inflicting minimum damage upon the aircraft.

Another object of the present invention is to provide a frangible enclosure which upon localized impact shatters into small pieces, e.g. pieces having a dimension of at most four feet.

It is another object of the present invention to provide a frangible enclosure for an antenna, which enclosure has an antenna window with anti-icing elements which do not compromise the frangibility of the enclosure.

A further object of the present invention is to provide a frangible enclosure that is easily fabricated, transported and handled.

Another object of the present invention is to provide a frangible enclosure having accessibility for personnel and which does not hinder the frangibility of the enclosure.

More particularly, it is an object of the present invention to provide a flooring system for access and support for maintenance personnel, which supports primarily vertical loads of personnel and equipment but also breaks up into separate pieces under normally horizontal impact loads.

SUMMARY OF THE INVENTION

To accomplish the foregoing and other objects, features and advantages of the invention there is provided an enclosure made of a plurality of panels, which panels are interconnected to form a housing. This housing has a shape such that a distributed load is resisted by primarily axial stresses in the panels and which generates little or no lateral bending stresses. The panels also have a low flexural strength. The panel will preferably have a constant double-curvature, but other shapes which have arch like structural properties can also be used. The material for the panel construction is preferably a composite laminate of fiber-reinforced material. Glass-flake reinforced material may also be used. Weakened portions can also be provided in the panels to reduce the flexural strength therein while maintaining adequate axial strength.

Weakened portions in the panel can be formed either by perforations or complete or intermittent discontinuities formed by cuts in the material. At least one layer of weak material spanning at least the weakened portions providing structural continuity are also preferable. This layer of weak material can be either fiber tape, foam core or a weak layer of fiber or flake-reinforced material. The weakened portions can be provided at intervals so that upon impact, the enclosure will break apart proximate to these areas into pieces having a maximum dimension of a predetermined, fixed size.

The radome window panels can also be provided with anti-icing elements which are useful when the enclosure is used in conjunction with an antenna. A ribbon type of wire, having a higher frangibility, is preferable to round wire. CuNi wire is also more frangible and solderable, making it preferable to other commonly used NiCr wire. The spacing of the wire is dependent upon the application thermal and electromagnetic requirements.

The enclosure of the present invention can also include a frangible floor system which breaks apart when subjected to a largely horizontal impact. The floor includes a support structure having a plurality of support elements comprised of interconnected support members. Upon the support elements, floor panels are laid. Both the floor panels and the support elements have means loosely cooperating with each other for locating and stablizing the support and the floor. Preferably, the floor panels have pins which loosely engage with a hole in the support elements. The loose cooperation of the support elements and floor panels facilitates the frangibility of the floor system.

In one embodiment, the support elements are spaced apart and are not connected to each other for support. The support members, constructed of a light weight frangible material, preferably foam, are interconnected with a weak layer of a composite laminate. A weakened portion is formed in the layer at the connection point of adjacent support members. These support elements rest upon and are supported by the floor of the enclosure.

In another embodiment, the support elements of the floor system include girder elements and beam elements, each formed of a plurality of interconnected support members. The support members, preferably made of aluminum are interconnected by means of connection plates and shear pins to form the support elements. Some support elements are girders, which are attached to support means of the enclosed structure. The beams are, in turn, attached to the girders, forming a support frame for the floor panels.

An access door for the enclosure is also provided. It is formed in a manner similar to a regular panel, however it has strengthened edges. Edges of the panel adjacent the door are also strengthened to provide better support for the hinges. The hinges are attached to brackets so as to facilitate alignment of the axes of the hinges. The door opens inward and has a latching mechanism to hold it closed.

BRIEF DESCRIPTION OF THE DRAWING

Numerous other objects, features and advantages of the invention should be apparent when the following detailed description is read in conjunction with the accompanying drawing in which.

DETAILED DESCRIPTION

Figure 1:
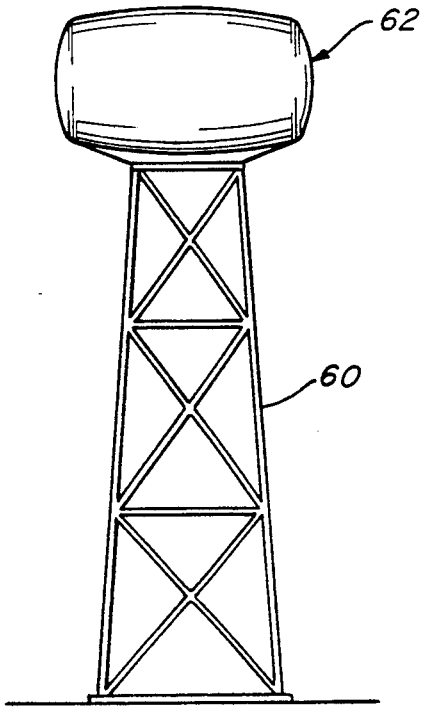
FIG. 1 is an elevational view of an enclosure for an antenna on an open tower, illustrating an embodiment of the present invention.
Figure 2:
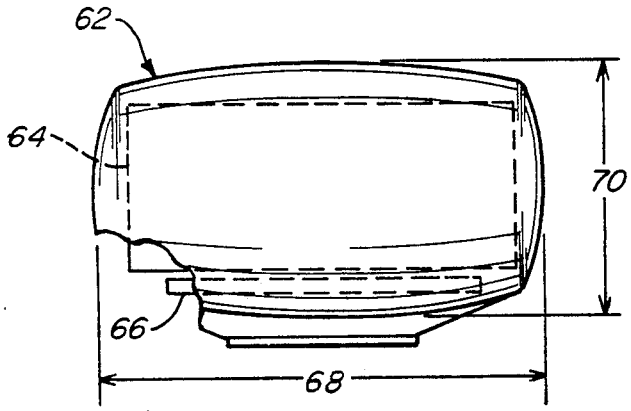
FIG. 2 is a front elevational view of the enclosure as shown in FIG. 1, showing the enclosed antenna and floor system in phantom.
Figure 3:
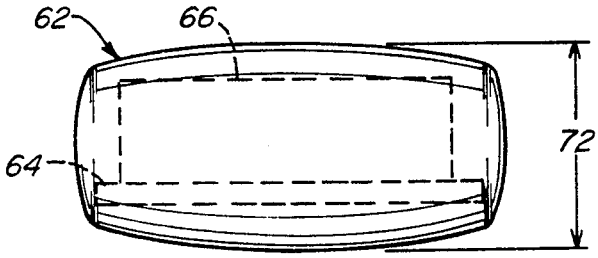
FIG. 3 is a top plan view of the enclosure shown in FIGS. 1 and 2.
Figure 4A:
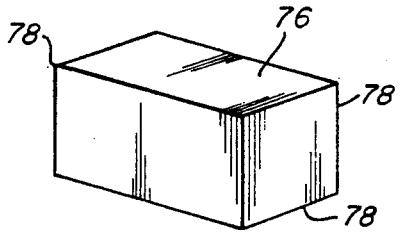
FIG. 4A is a diagrammatic illustration of a box shaped enclosure.
Figure 4B:
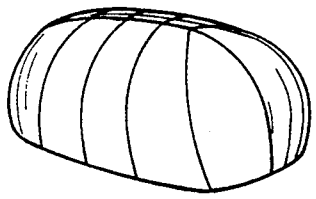
FIG. 4B is a diagrammatic illustration of an inflatable bag shaped enclosure.
Figure 4C:
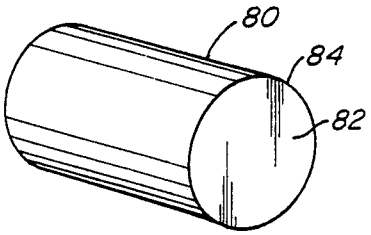
FIG. 4C is a diagrammatic illustration of a cylindrical shaped enclosure.
Figure 4D:
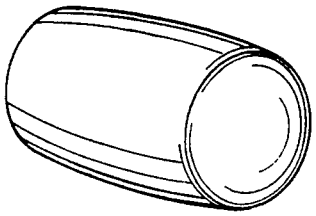
FIG. 4D is a diagrammatic illustration of the double curvature monocoque shell shape for the frangible enclosure of the present invention.

FIGS. 1–3 illustrate an antenna tower such as one for which a frangible enclosure of the present invention is used. Such an enclosure may also be installed at ground level. A radar antenna, supported on an open tower 60, or other structure can be protected by an enclosure 62. The antenna 64 (shown in phantom, FIG. 2) is supported by the tower 60 and is accessible by maintenance personnel. Personnel are supported by the floor 66 (also shown in phantom). The floor in the frangible enclosure does not support the antenna 64; the antenna usually is fixed on and supported directly by the tower 60.

An enclosure for an azimuth antenna, as illustrated in FIG. 2, typically might have a length 68 of about 14 feet, and a height 70 of about 7.5 feet. Dimensions will vary for other types of enclosures. The enclosure 62, illustrated in FIG. 3, also has a typical width 72 of about six feet. The floor 66 (shown in phantom) substantially covers the base of the enclosure 62, and the antenna 64 is normally proximate to one side of the enclosure 62.

An enclosure for an antenna can take on one of a variety of different shapes such as those illustrated in FIGS. 4A through 4D.

A box shape (FIG. 4A) is often used as a shape for an enclosure. This shape, having flat panel sides 76, provides cost savings advantages because of the availability of material in rectilinear form and because of the flat surfaces that simplify fabrication. However, flat surfaces and straight frame members have the same failure mode, i.e. bending, for either distributed loads or localized impact loads. This failure mode makes it difficult to design panels able to sustain one type of load but fail under the other. Moreover, the high wind drag coefficients of a box shape require greater enclosure and tower strength, making low impact resistance more difficult. Finally, high wind turbulence at the corners 78 creates vibration and torquing of the structure that can adversely affect antenna performance.

An inflatable air bag (FIG. 4B) may also be used for an enclosure. It has the advantages of light weight and low initial cost. However, its reliability is questionnable, since its inflation needs to be maintained. Large deflections under wind loading also necessitate greater clearance from the enclosed equipment, resulting in a larger envelope with greater drag forces. Moreover, providing specific structures to improve frangibility is difficult. Finally, the need for air locks at entrances and the long-term cost of power and blower equipment maintenance render this type of enclosure difficult to use.

A cylindrical enclosure (FIG. 4C) has the advantage of a lower draw coefficient than a box structure. If it is a true cylinder, it has single curvature sides 80 and arch like properties that are structurally advantageous. However, any flat panels 82 used in construction of a cylinder have the same shortcomings as the flat panels of a box enclosure. In particular, if the cylinder ends are flat, there is also a turbulent wind flow at the intersecting edges 84 of the cylinder.

In view of the disadvantages of other shapes, a double-curvature monocoque shell (FIG. 4D) configuration was chosen because it has structural characteristics, i.e. arch like properties, that are inherently adapted to this application. Distributed forces acting on a double-curvature shell are resisted by axial stresses within the shell, resulting in relatively low unit axial and edge shear stresses. Because of the arch like structure no, or little, bending moment is induced by the stresses from a distributed load. Since lateral bending stresses are not present, or are very low, high flexural strength is not reguired. A double-curvature shell having adequate tensile, compressive and edge shear strengths in thicknesses that will sustain distributed axial stresses from a wind load can be designed fail under local bending stresses of a concentrated load imposed by a colliding aircraft. This failure can be enhanced by lowering the flexural strength of the material in a manner that maintains the axial strength. It is further preferable to utilize materials having low flexural strength and low weight. Although a sphere shape can be used, it may be more advantageous to use a more elliptical shape because a smaller size can be obtained. The smaller size will also reduce the load incurred on the enclosure.

Figure 5A:
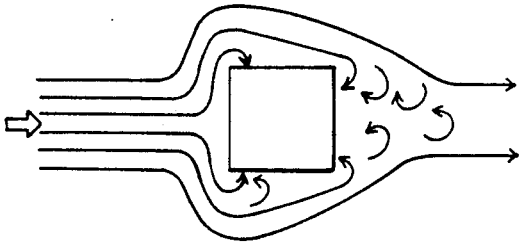
FIG. 5A is a diagrammatic illustration of the wind pattern caused by an enclosure of the shapes described in FIGS. 4A and 4C.
Figure 5B:
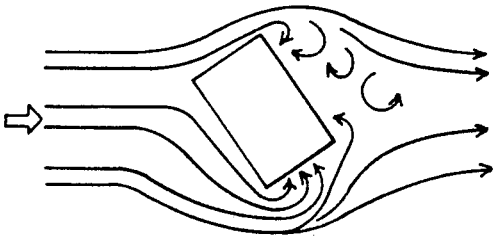
FIG. 5B is a diagrammatic illustration of the wind pattern caused by an enclosure of the shape described in FIG. 4A.
Figure 5C:
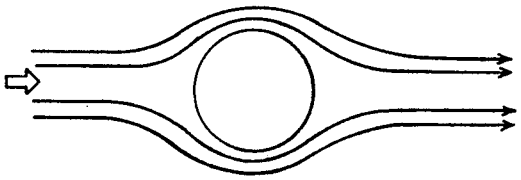
FIG. 5C is a diagrammatic illustration of the wind pattern caused by an enclosure of the shape described in FIG. 4C and the shape of the present invention described in FIG. 4D.
Figure 5D:
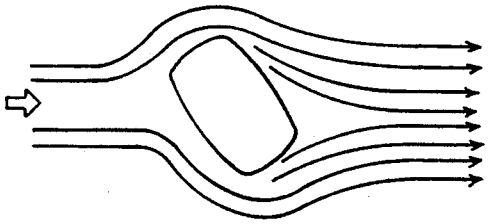
FIG. 5D is a diagrammatic illustration of the wind pattern caused by the shape of the frangible enclosure of the present invention as described in FIG. 4D.

FIGS. 5A through 5D illustrate wind patterns generated by the enclosures of FIGS. 4A through 4D. A wind pattern such as illustrated in FIG. 5A will result from a box shape or a cylinder with a flat end substantially perpendicular to the wind. The wind pattern of FIG. 5B will also be caused by a box. FIG. 5C illustrates the wind pattern on a cylinder or double-curvature shell. A wind pattern similar to that illustrated in FIG. 5D is provided by the double-curvature shell. The double-curvature shell thus therein reduces stresses caused by a distributed wind load more than shells having other shapes because of its reduced drag.

Enclosures are reguired at airports, at least for azimuth antennas elevation antennas and precision distance measuring equipment. Enclosures may also be used for other uses as well such as for housing electronic, fire safety and other types of equipment. The formation of these enclosures as double curvature shells will now be described in greater detail in connection with in FIGS. 6—11.

The azimuth antenna enclosure 90 (FIG. 6, antenna in phantom) has a convex surface of revolution about a horizontal axis 91. It comprises double-curvature panels 92, 94, 96, 98 and end caps 100 with spherical curvature. A radiused corner zone 102 on the end caps makes the transition between the spherical ends 100 and the central panels 92, 94, 96, 98. Each spherical end 100, including its radiused corner zone 102 at its perimeter, is formed as a single circular panel. The double curvature central portion is divided into four roughly rectangular panels 92, 94, 96, 98 of two sizes. Base panels 92 and zenith panels 94 are similarly sized. Of the side panels, one, 96 (FIG. 6), contains an antenna window; the other, 98 (FIG. 7) may contain an access door 104. The base panel 92 is connected along one side to the window panel 96 and along the opposite side to side panel 98. Zenith panel 94 is connected along one side to the window panel 96, opposite the base panel 92, and along its second side to the door panel 98, forming a double-curvature tube or central portion. End panels 100 are connected to opposite ends of the central portion, forming a double-curvature shell. The base panel 92 of the Azimuth antenna enclosure is attached to the tower 60 with a connection means 106. This connection is described later in greater detail in connection with FIGS. 16 through 18. A railing 108 can also be provided for personnel safety.

In order to effect savings in tooling and fabrication, a large elevation antenna enclosure 110 (FIGS. 8—9) is identical in overall shape to the azimuth antenna enclosure 90. It has a convex surface of revolution about a vertical axis 111. The circular base panel 112 and zenith panel 114 are similar to the end caps 100 of the Azimuth antenna enclosure. The central portion comprises five side panels, including a antenna window panel 116 (FIG. 8), a side panel 118 (FIG. 9) with an access door 104 and three other panels 120, 122, 124.

The window panel 116 is connected along one edge to a side panel 120, and along the opposite edge to side panel 122. The edge of side panel 122 opposite the radome window is connected to panel 124. Panel 124, in turn, is connected to door panel 118 along the edge opposite panel 122. Panel 118 is then connected to side panel 120 to complete the double-curvature, tube-like center portion. Zenith panel 114 and base panel 112 are then attached to all panels 116, 118, 120, 122 and 124 at opposite ends of the tube-like structure to form a double-curvature shell.

Similar to base panel 92 of the azimuth antenna enclosure 90, the base panel 112 of the large elevation antenna enclosure 110 is attached to a tower 60 via a connection means 106. This connection is described in greater detail in connection with FIGS. 16 through 18.

Figure 11:
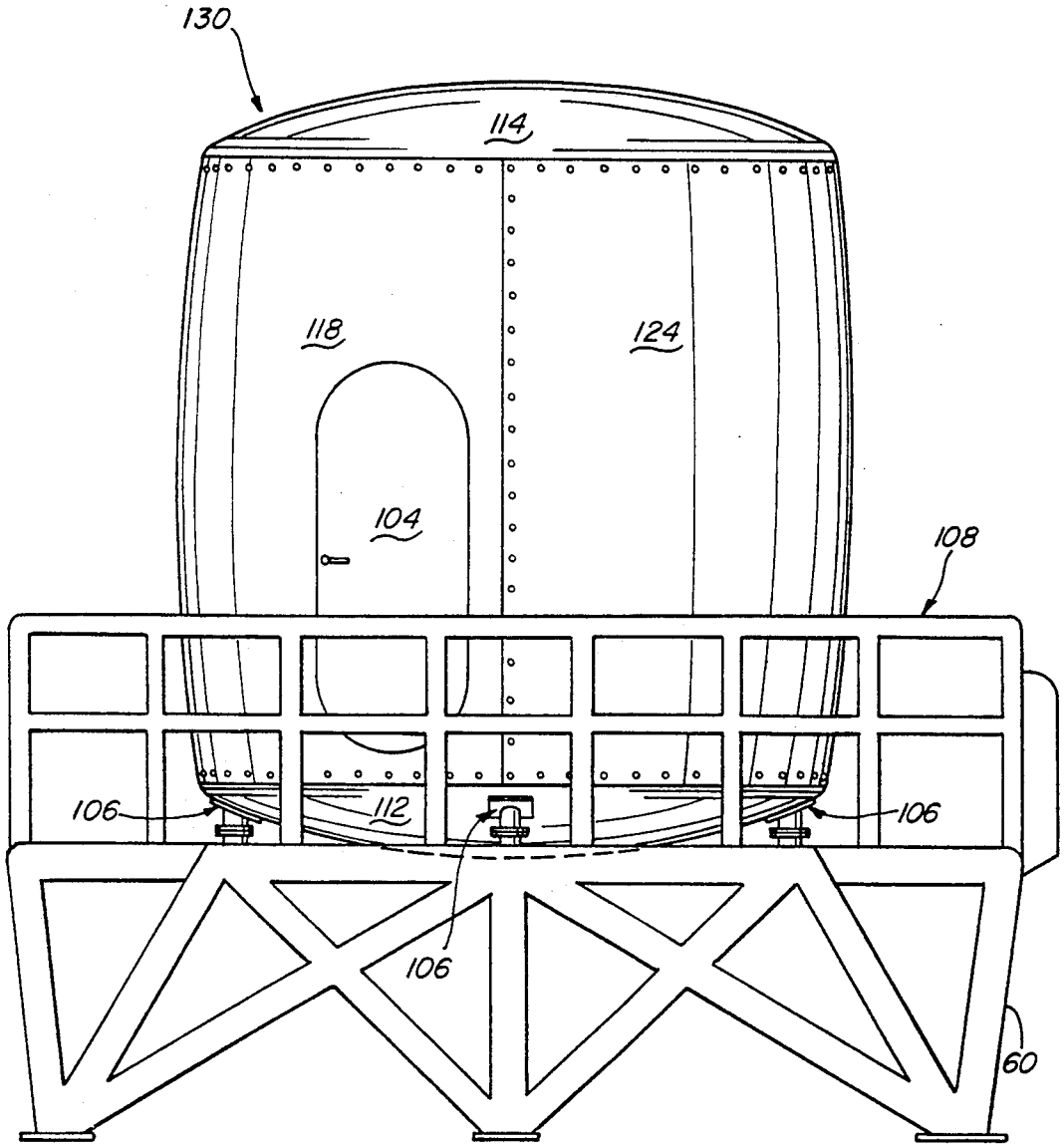
FIG. 11 is a back elevational view of an enclosure for an elevation antenna or precision distance measuring equipment.

A small elevation antenna enclosure 130 (FIGS. 10—11) has the same vertical orientation and the same equatorial diameter as the large elevation antenna enclosure but is approximately four feet shorter in overall height. It can be manufactured in the same way as the small elevation antenna enclosure. The side panels 116, 118, 120, 122, 124 are truncations of those of the large elevation antenna enclosure; the spherical ends 112, 114 have the same curvature but are slightly larger. The precision distance measuring equipment enclosure 130 of FIG. 11 is identical in overall shape to the small elevation antenna enclosure and has the same orientation, but has no need for a window panel 116. This panel can be constructed in the same way as other panels in the enclosure.

Figure 6:
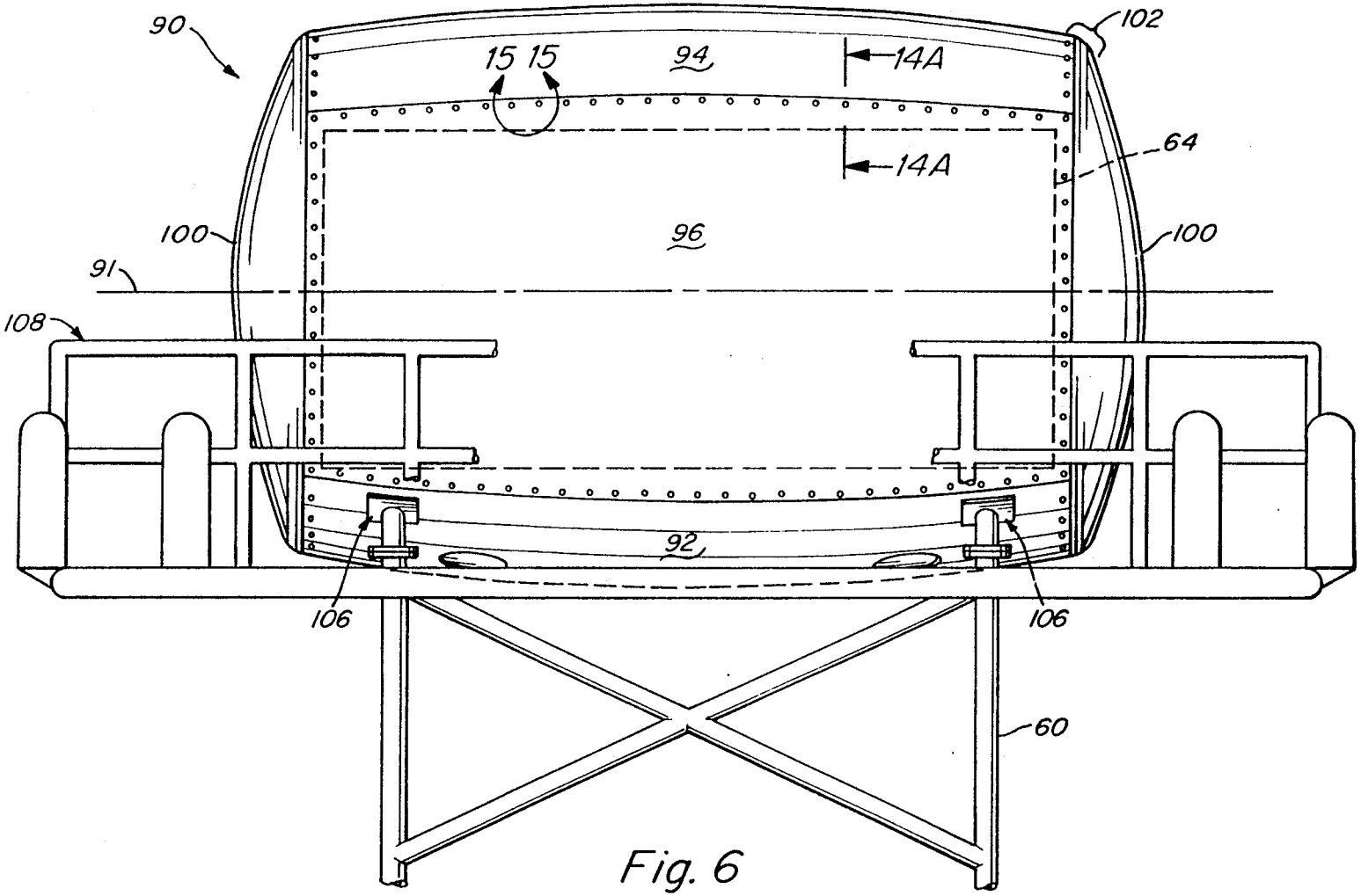
FIG. 6 is a front elevational view of an enclosure for an azimuth antenna.
Figure 7:
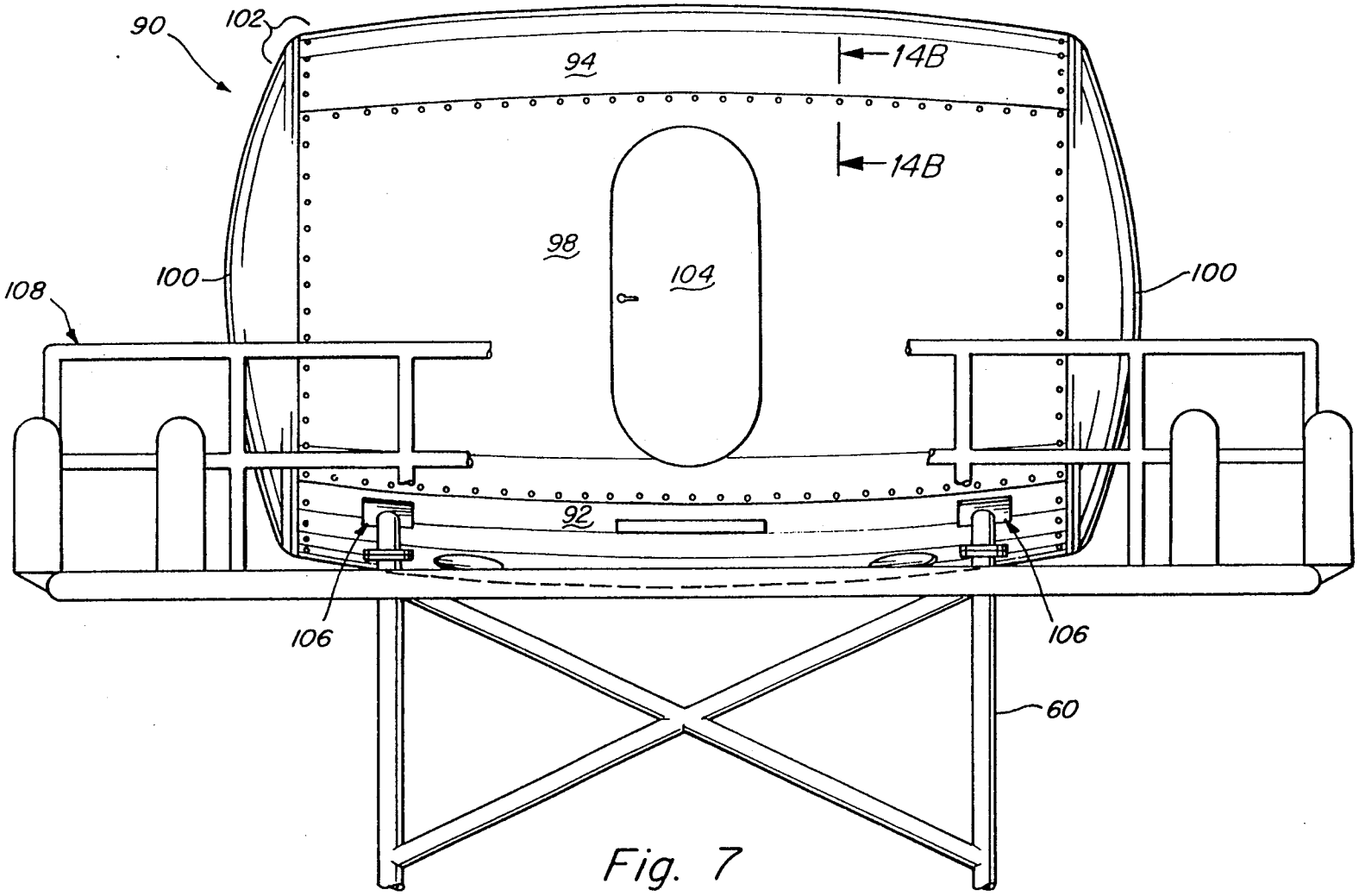
FIG. 7 is a back elevational view of an enclosure for an azimuth antenna.
Figure 8:
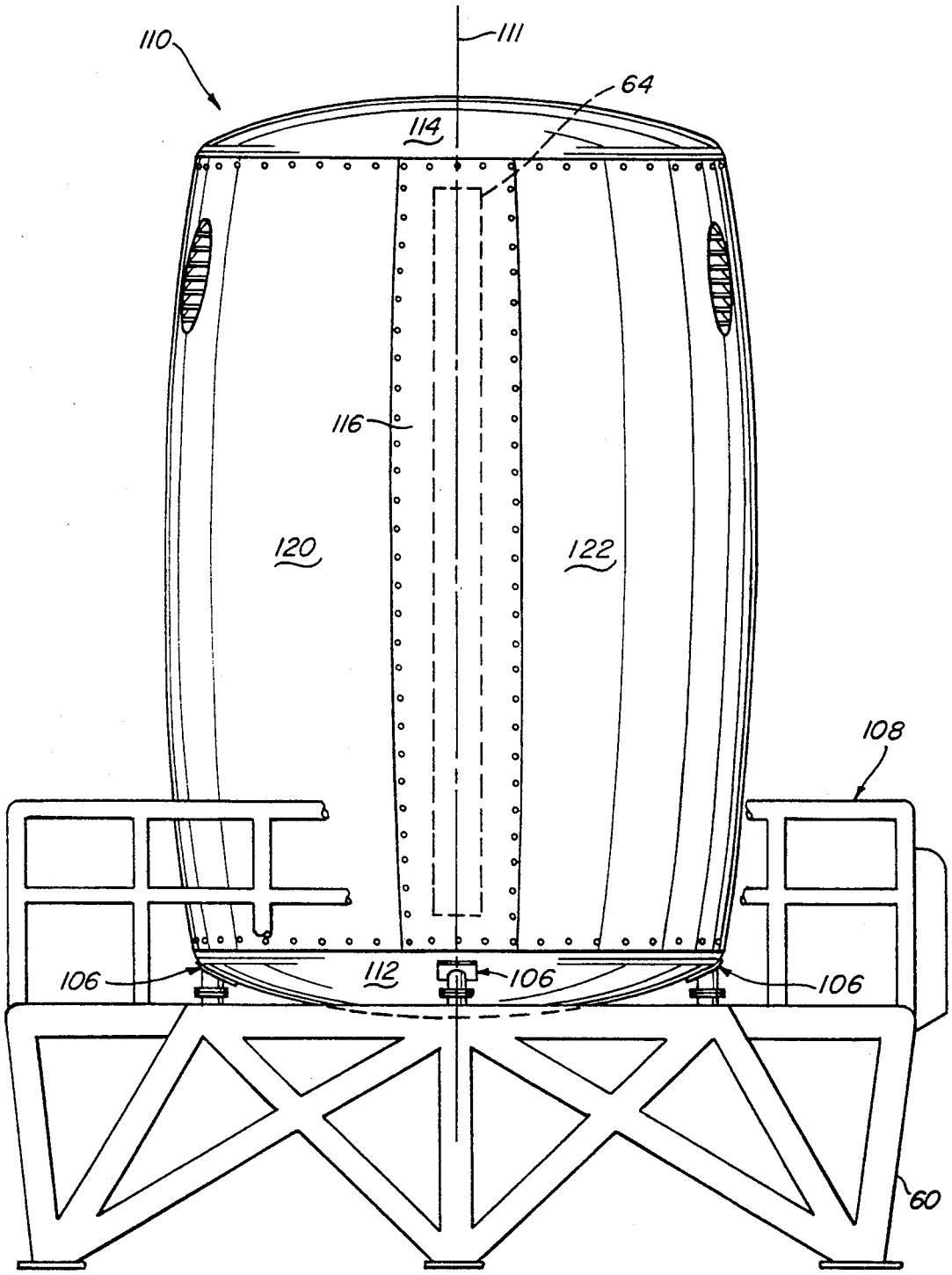
FIG. 8 is a front elevational view of an enclosure for an elevation antenna.
Figure 9:
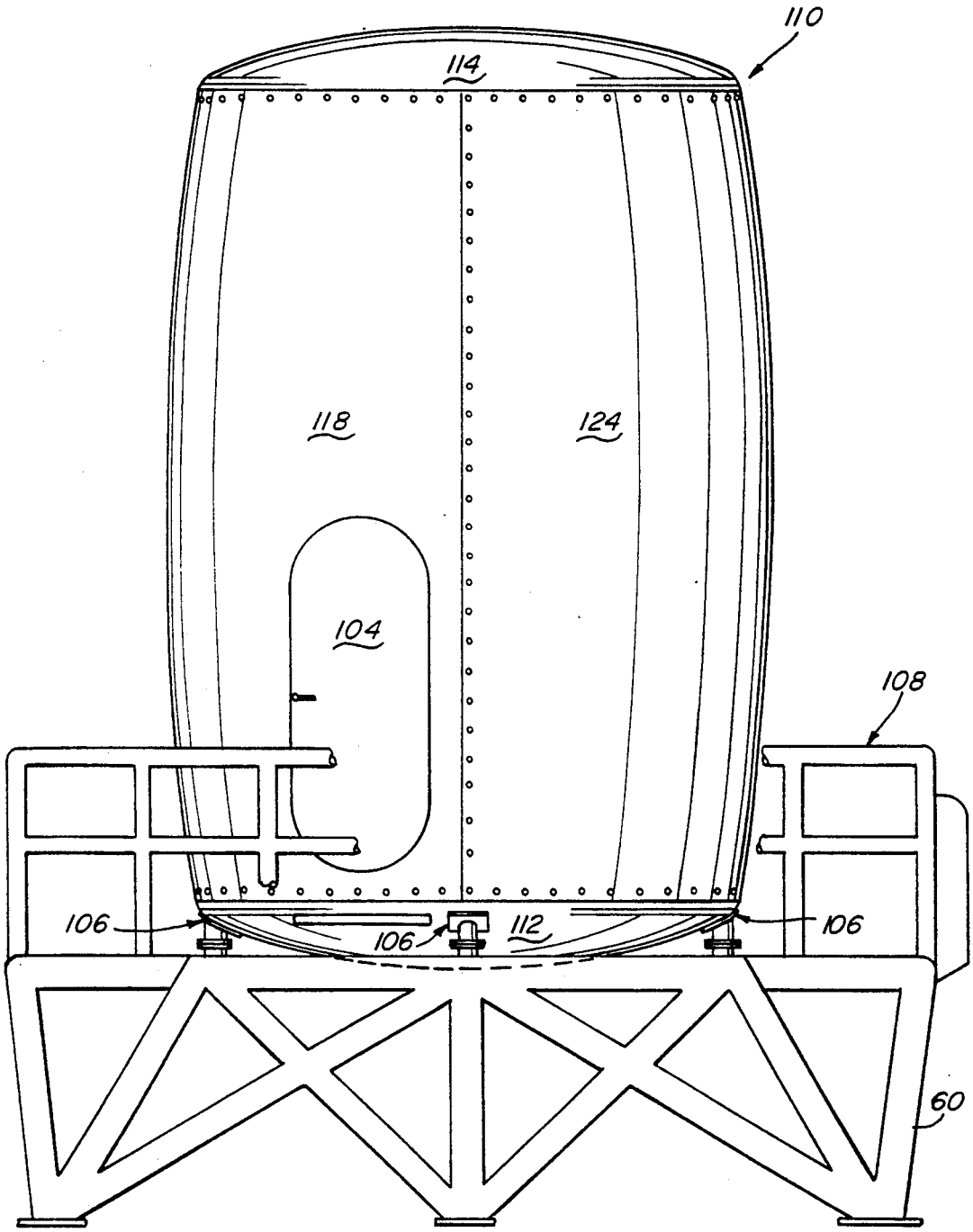
FIG. 9 is a back elevational view of an enclosure for an elevation antenna.
Figure 10:
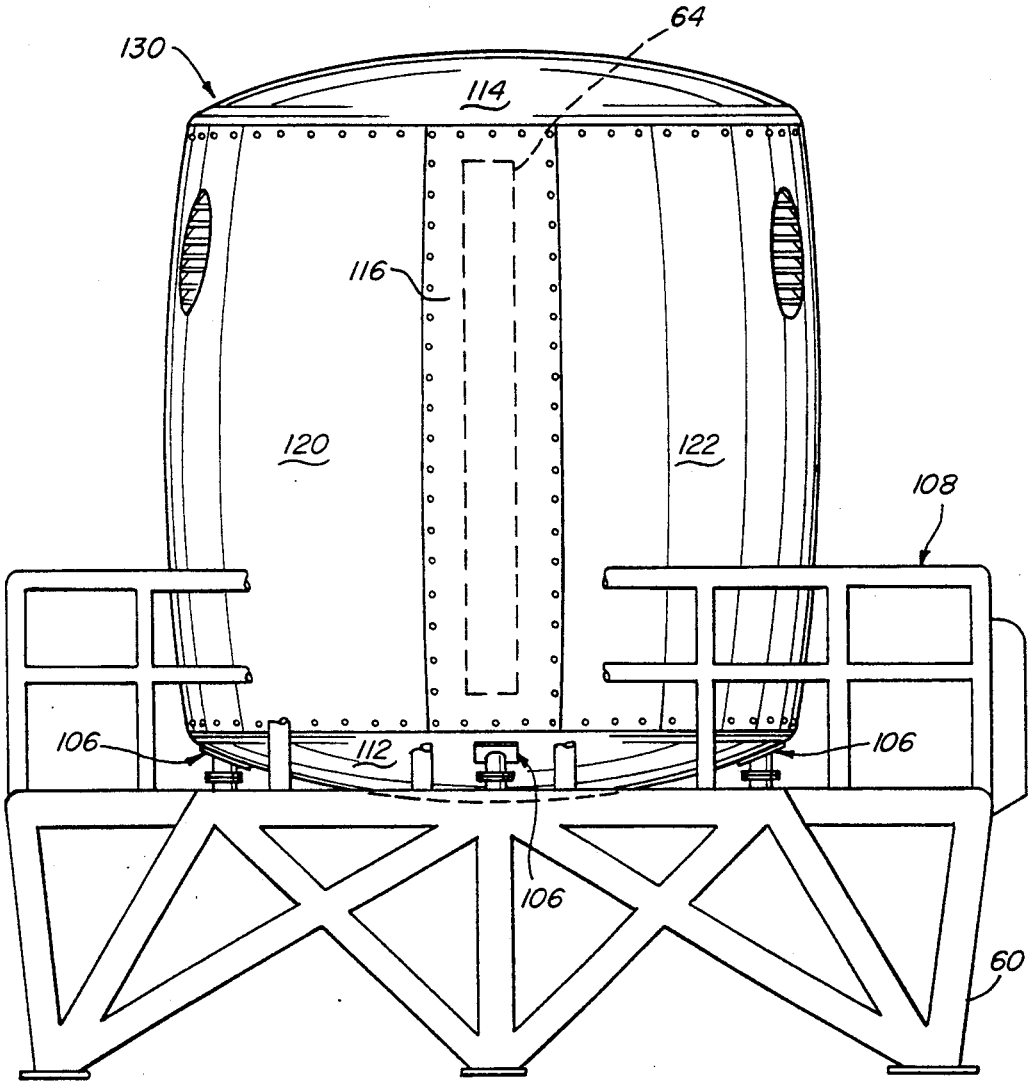
FIG. 10 is a front elevational view of an enclosure for an elevation antenna or precision distance measuring equipment.
Figure 12:
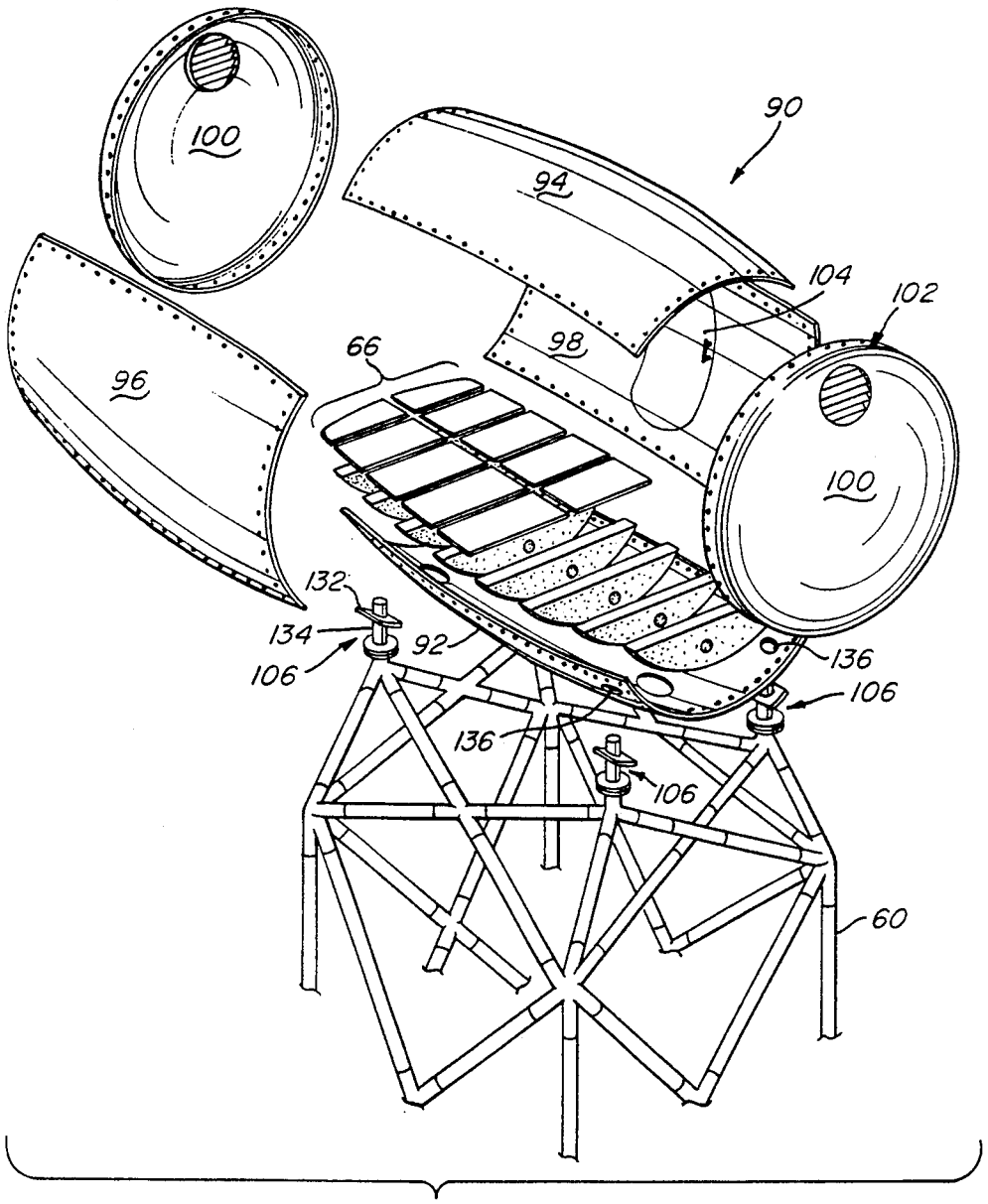
FIG. 12 is an exploded isometric view of an enclosure for an azimuth antenna.

FIG. 12 is an exploded isometric view of an enclosure for an azimuth antenna as previously described in connection with FIGS. 6 and 7. Elevation antenna enclosures will have substantially similar construction. The enclosure surrounds an antenna (not shown) and a floor 66 as previously mentioned in connection with FIGS. 1-3. The enclosure is connected to the tower 60 via a connection means 106 which includes a plurality of support plates 132 and associated connection stubs 134. Each stub 134 is inserted through a corresponding hole 136 in the base panel 92. The support plates 132 distribute the load of the enclosure around the hole 136 in the base panel and onto the tower 60. A suitable securing member (not shown) can secure the enclosure 90 to the support plate 132. An antenna (not shown) can then be attached to stub 134. In this configuration, the antenna is supported only by the tower 60 and does not cause additional loading on the enclosure 90. This connection will be described later in more detail in connection with FIGS. 16 through 18.

Figure 13:
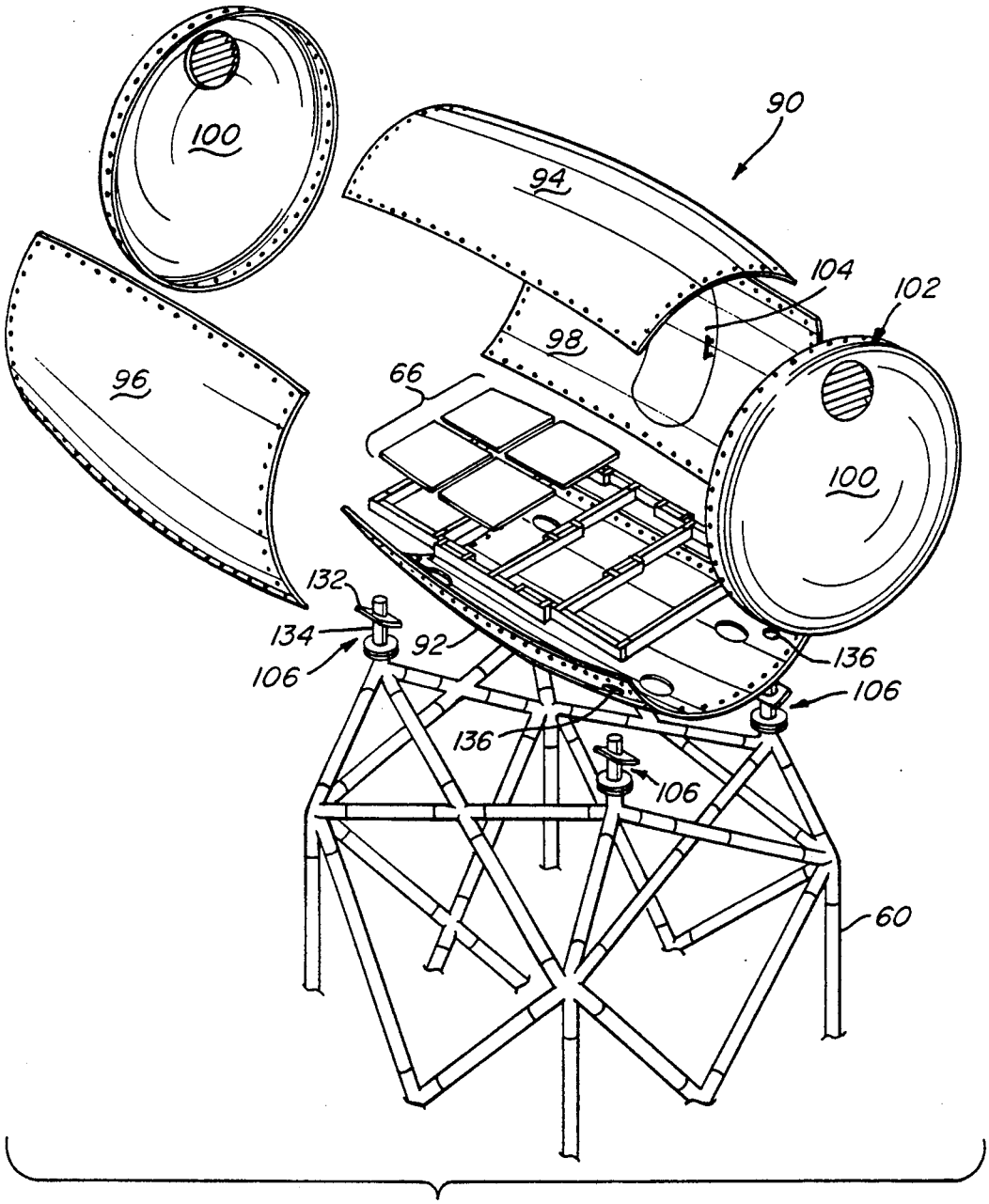
FIG. 13 is another exploded isometric view of an enclosure for an azimuth antenna.

FIG. 13 is another exploded isometric view of an enclosure for an azimuth antenna as previously described in connection with FIGS. 6 and 7. An alternate construction of the floor system 66 is illustrated. Details of the construction of the floor system 66 are described later in further detail in connection with FIGS. 36 through 40.

Figure 14A:
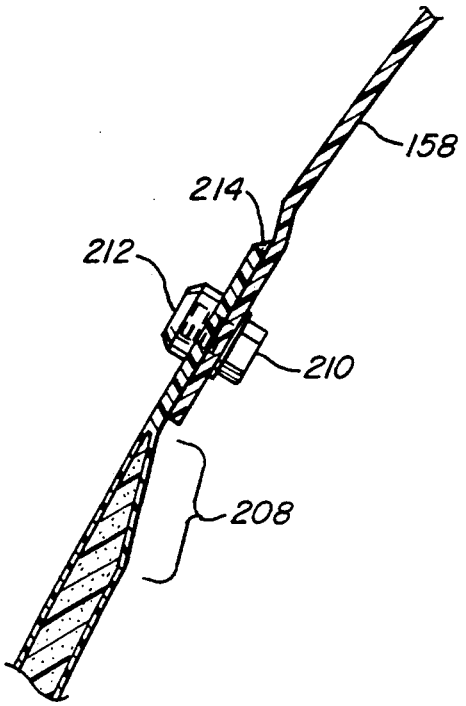
FIG. 14A is a diagrammatic cross sectional view of the area of connection of two adjacent panel as taken along line **14*a*—14*a* of FIG. 6**.
Figure 14B:
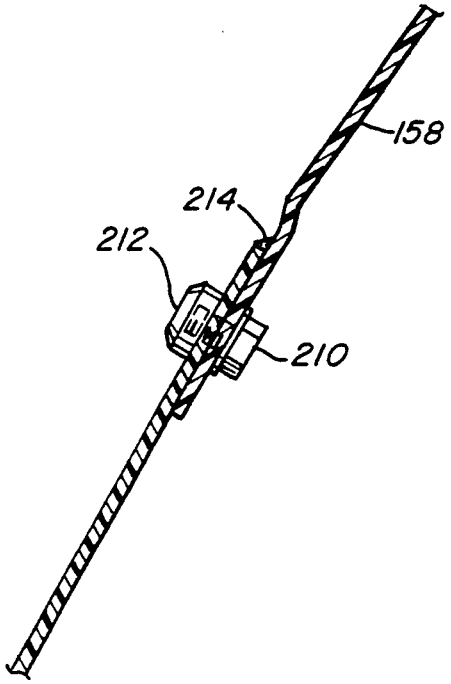
FIG. 14B is a diagrammatic cross sectional view of the area of connection of two adjacent panels as taken along line **14*b*—14*b* of FIG. 6**.
Figure 15:
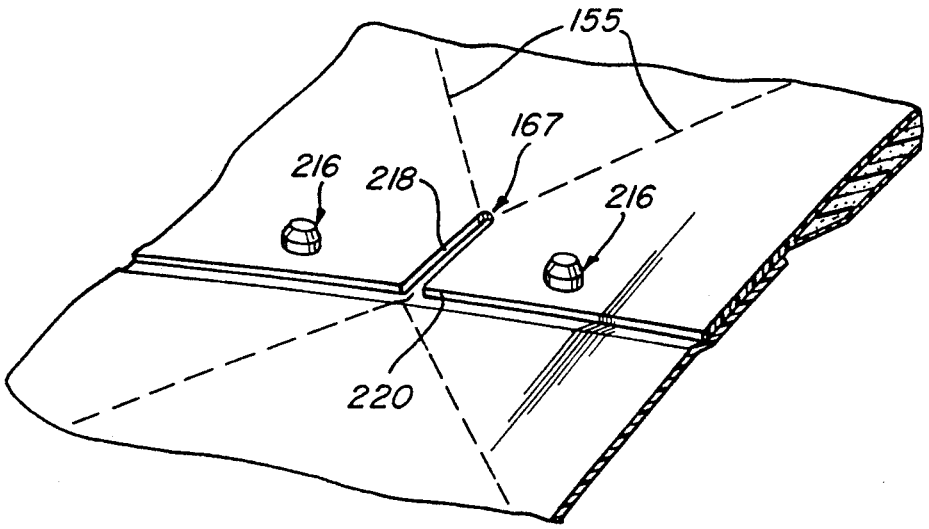
FIG. 15 is a detailed isometric view of the area in circle 15–15 of FIG. 6 of connection of two adjacent panels.

The plurality of panels are interconnected to form an enclosure. The interconnection of panels is illustrated in FIGS. 14A, 14B and 15. A panel, if necessary, is tapered at the edge 208 (FIG. 14A) forming a solid flange. The thickness of this flange is made consistent among panels, thus providing a modular means for interconnecting panels. This connection area also transfers loads between panels. It is also possible that no tapering will be needed as shown in FIG. 14B. The connection of two panels is made with a plurality of connecting bolts 210 and captive T-nuts 212. At the connection, a caulked joint 214 is also formed, to form a seal for preventing moisture from entering the enclosure. A gasket (not shown) can also be inserted between panels at the connection points in lieu of the caulking. A gasket enables easier and quicker replacement of a panel than does caulking. The gasket preferably is formed of a plurality of thermoplastic strips which have a maximum length less than the desired breakage size, e.g. four feet, which provide a seal between two panels.

FIG. 15 illustrates the surface detail of the connection of two panels. Between two connection points 216 a notch 218 is made in each panel. Notch 218 is formed intermediate connection points 216 from the edge 220 of the panel to a weakened in the panel. Formation of these weakened portions is discussed late in more detail in connection with FIGS. 19 through 25.

Figure 16:
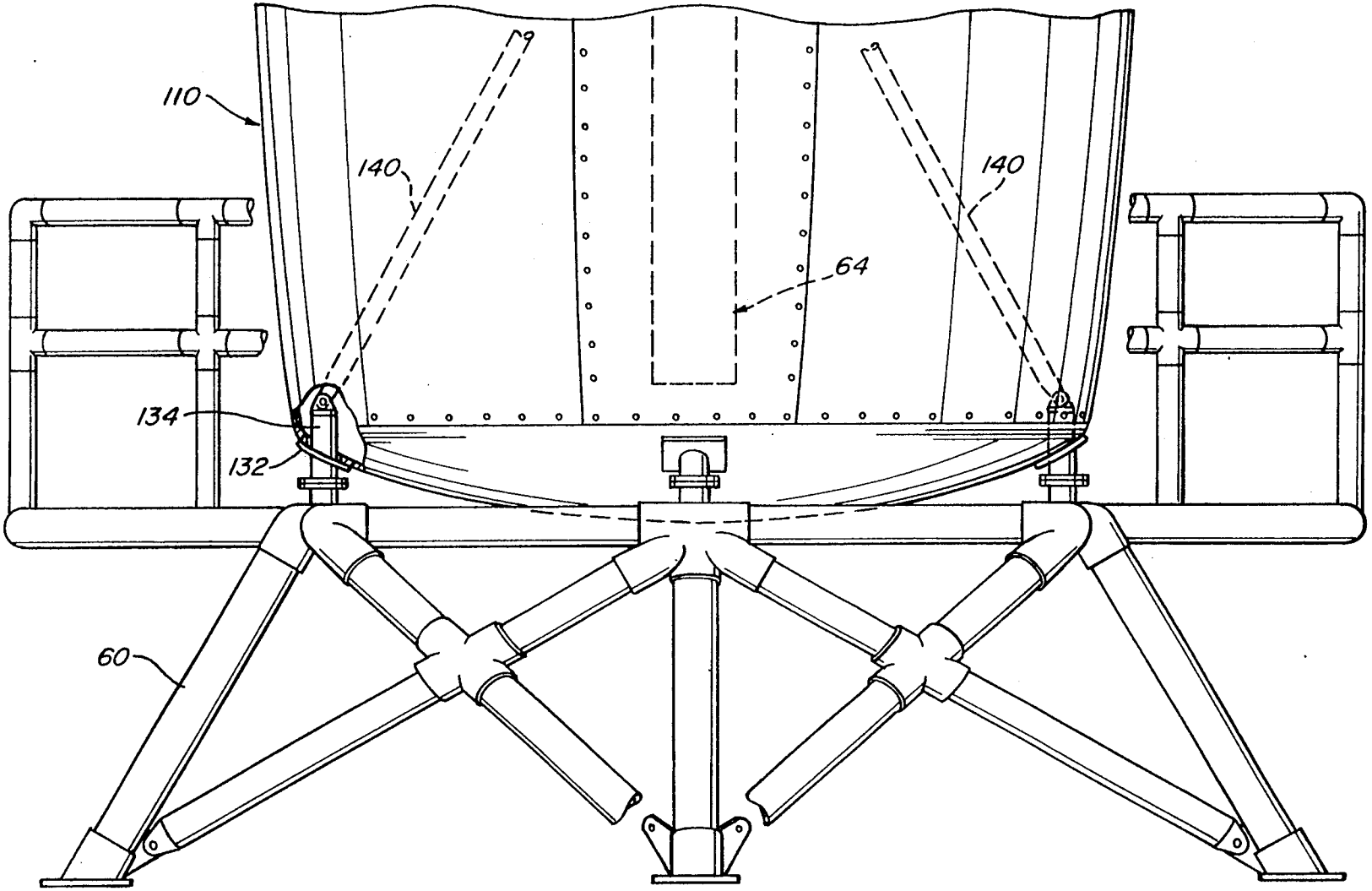
FIG. 16 is a cross-sectional elevational view of the base of an enclosure for an elevation antenna.
Figure 17:
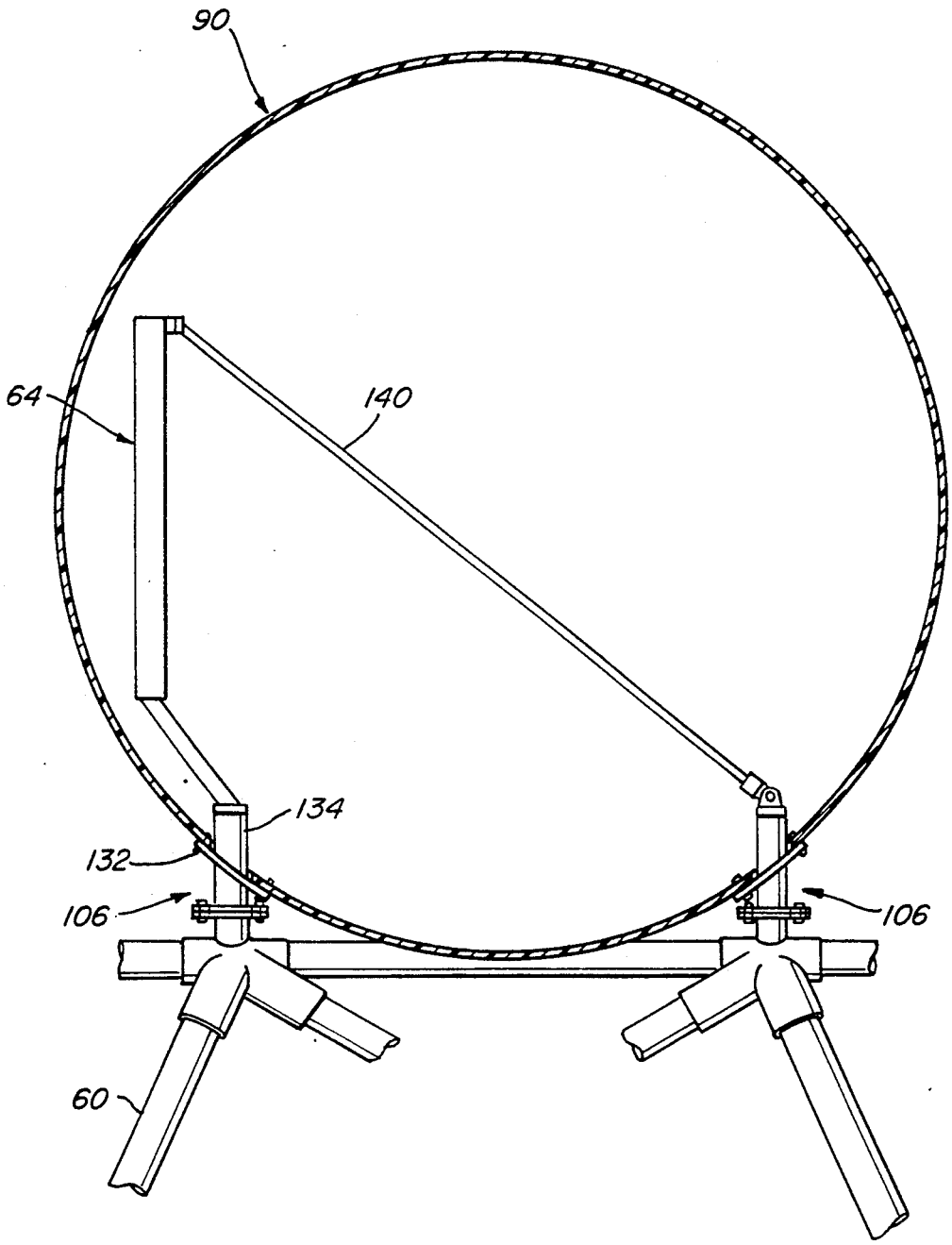
FIG. 17 is a cross-sectional elevational view of an end of an enclosure for an azimuth antenna.
Figure 18:
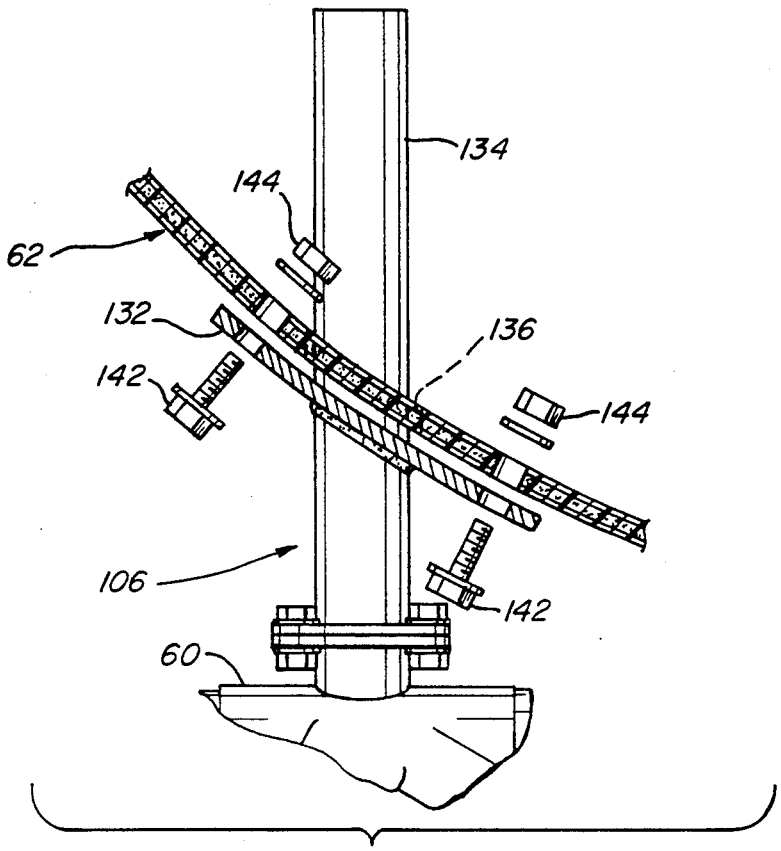
FIG. 18 is a detailed cross sectional view of the area of connection of an enclosure to the support tower.

FIGS. 16—18 illustrate the connection of enclosures 90 and 110 and an antenna 64 to a tower 60. The antenna 64 is attached to the end of a stub 134 via an attachment means 140 shown in phantom (FIGS. 16 and 17). The support plate 132 (see FIG. 18) is connected to the enclosure base panel with a bolt 142 and nut 144. In this manner of connection, the enclosure and the antenna are supported separately by the tower 60.

Figure 19A:
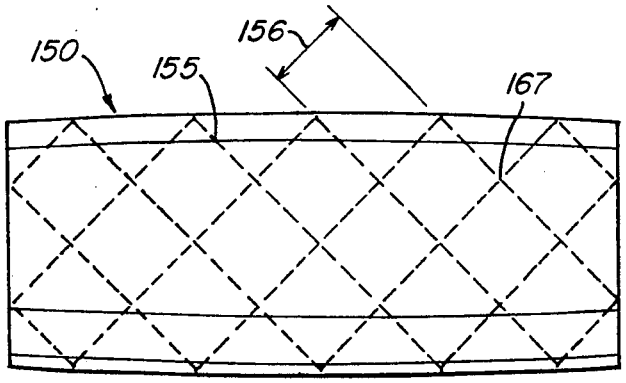
FIG. 19A is a plan view of a panel for an enclosure.
Figure 19B:
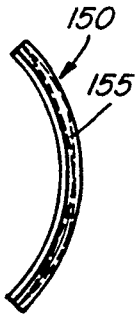
FIG. 19B is the side plan view of the panel of FIG. 19A.
Figure 19C:
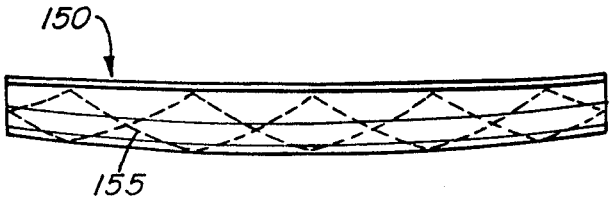
FIG. 19C is a top plan view of the panel of FIG. 19B.

For ease of fabrication, transportation and handling, the enclosure shell is subdivided into panels. The panel construction will now be discussed in connection with FIGS. 19A through 19C, illustrating of panel for the preferred embodiment of a double-curvature shell. Single-curvature or flat panels can also be made by having no curvature in one or two directions, respectively. One mold may be used to fabricate many different size panels and thus different size enclosures each having the same equatorial diameter. Not only is the modularity of the enclosure improved by this construction, but the tailoring of an enclosure to specific design requirements can be obtained with little effort.

A curved panel, as discussed above, has structural advantages over flat panels. A curved panel resists distributed forces by axial stresses within the panel but has low resistance to concentrated loads. In a flat panel, both loads cause flexural stresses. Since a concentrated load will induce high bending stresses, weakening of the flexural strength of the panel will facilitate breakage. In such a curved panel, weakening of the flexural strength minimally affects the resistance of the panel to distributed load whereas in a flat panel weakening of the flexural strength will greatly reduce its resistance to distributed loads.

Composite materials have been chosen for the panel construction because strength properties of a panel can be accurately controlled by varying the number and type of layers of reinforcing material. These materials also have a history of reliability in various applications. These composite materials are laminates of primarily fiber are inforced material such as fiberglass, graphite, polyester fiber and aramides. A moldable reinforced sheet material can also be used. A layer of foam or honeycomb core can also be incorporated in the laminate because of its high frangibility and low weight.

A panel 150, preferably having a double-curvature and constructed from a composite material, is provided with at least one weakened portion 155 (FIG. 19A) in order to weaken the flexural strength of the panel. Weakened portions can be provided at intervals 156 so as to ensure that the maximum length in any direction of a fractured piece after impact does not exceed a predetermined size (e.g. four feet). To achieve a four foot maximum dimension, interval 156 would be about 2.8 feet. Of course, the weakened portions could be spaced at different intervals in each direction, or at non uniform intervals.

Figure 20:
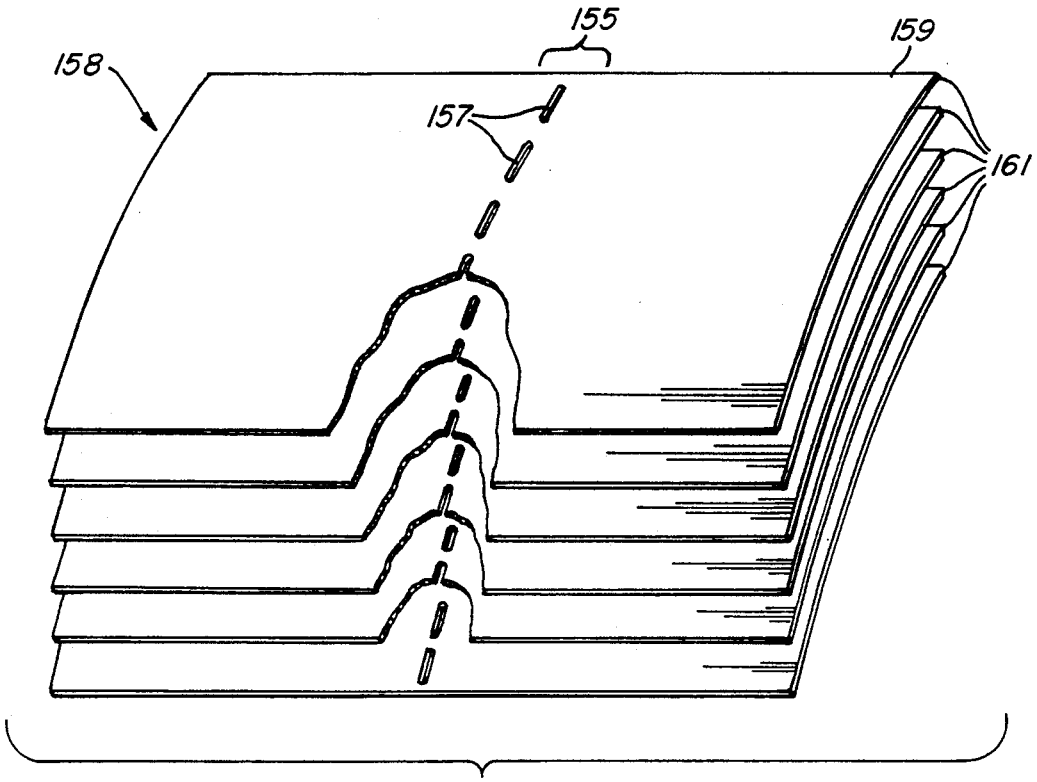
FIG. 20 is an exploded cut-away isometric view of a first embodiment of a panel with a weakened portion formed therein according to the invention.
Figure 21:
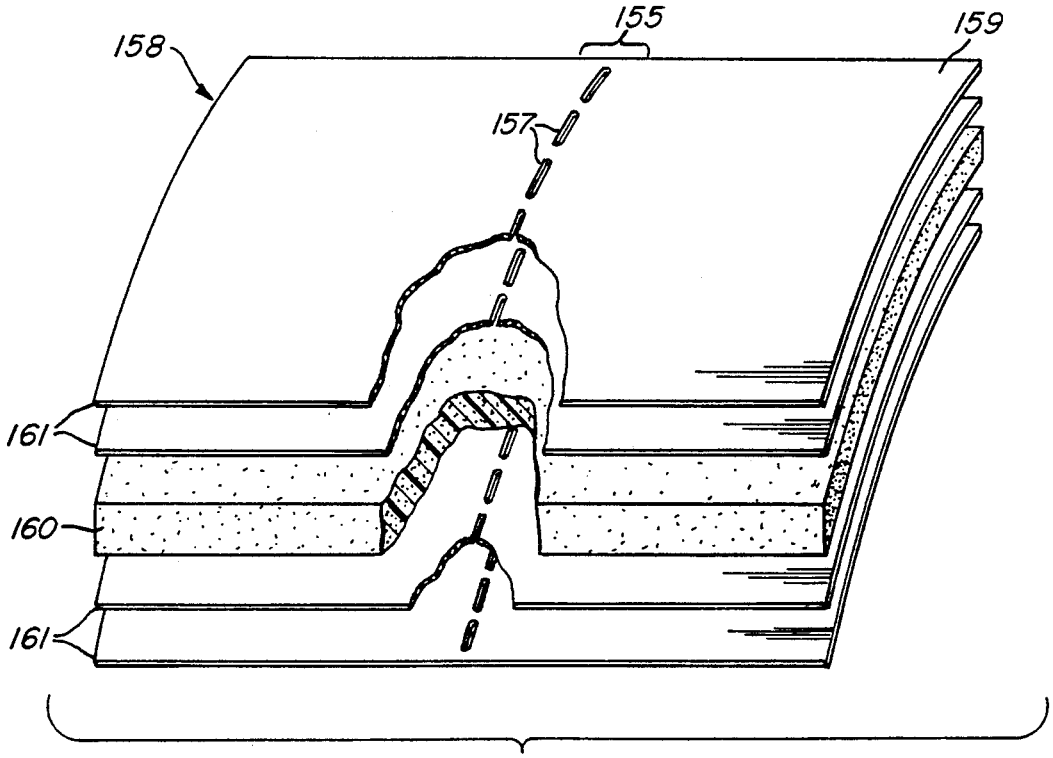
FIG. 21 is an exploded cut away isometric view of an alternative construction of the first embodiment of the invention.

In one embodiment of the invention, a weakened portion 155 is formed in a panel by a perforation 157 (FIG. 20). Perforations can be made with either slits, or cuts, in the material or by drilled holes. Slits are preferable in view of the high production costs for drilling.

A panel 150 having weakened portions 155 formed by perforations 157, also called a sandwich panel 158, is comprised of a plurality of layers of fiber reinforced material 159, forming the structure shown in FIG. 20. A core 160 can be a included in the laminate, disposed substantially in the center of the layers of material 159, forming the structure shown in FIG. 21. The core 160 can be a honeycomb, polyurethane closed-cell foam or other similar material. When the panel 158 is cured, the core 160 is preferably covered completely by the layers of material 159 or skins 161, so that the core 158 is completely encapsuled to prevent moisture from seeping into it. The material for the skins 156 is preferably a reinforced laminate, fabricated with polyester resin, pre impregnated glass fabric. The use of pre impregnated material has the advantage of having a controlled resin-to-glass ratio which provides for consistent structural and electrical properties and laminate thickness.

Figure 22:
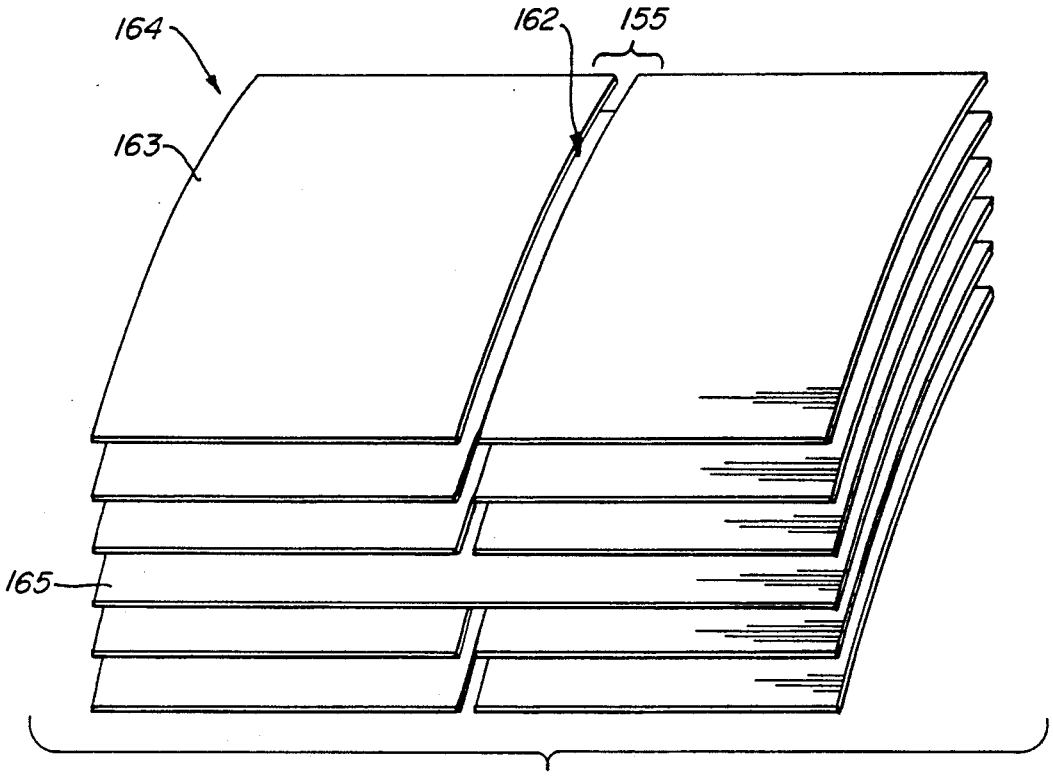
FIG. 22 is an exploded cut away isometric view of a second embodiment of a panel with a weakened portion formed therein according to the invention.
Figure 23:
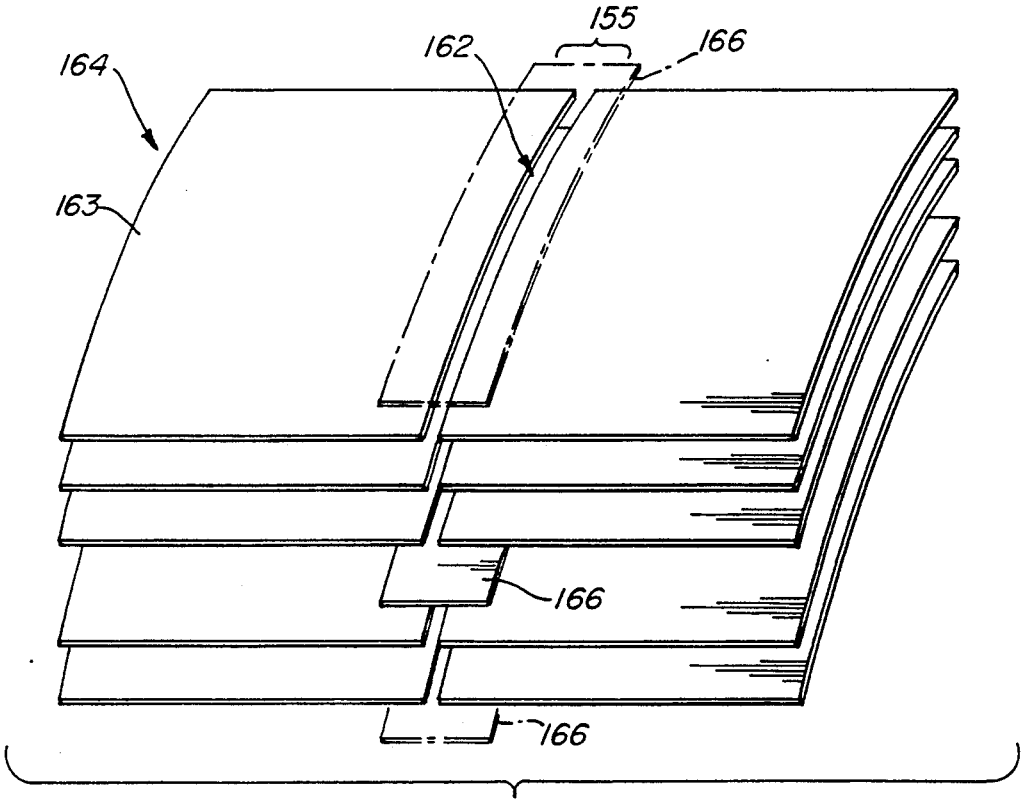
FIG. 23 is an exploded cut away isometric view of an alternative construction of the second embodiment of the invention.
Figure 24:
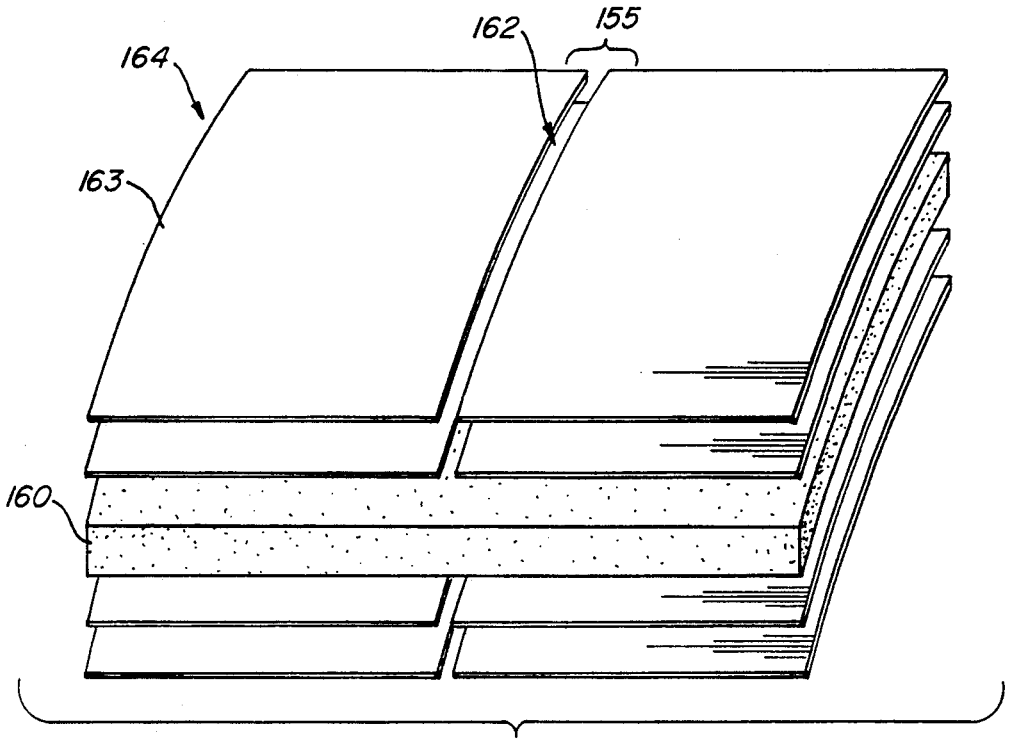
FIG. 24 is an exploded cut away isometric view of another alternative construction of the second embodiment of the invention.

A weakened portion 155 can also be found in a panel 150 by forming a complete discontinuity 162 (FIG. 22). A complete discontinuity is formed by cutting completely through a layer 163 of material. A panel formed in this manner is called a solid laminate panel 164. One or more layers of weak material 165 are used to join these discontinuous sections together and to provide structural continuity of the laminate. These one or more layers of weak material 165 should provide adequate axial strength but should be flexurally weak. This layer of material 165 can be a thin, fiber reinforced layer or a tape 166 (See FIG. 23) having a weave providing adequate axial strength but minimal bending strength in the region surrounding the weakened portions 155. This layer of material 165 can be included in the laminate either disposed between layers of material 163, as shown in FIG. 22 or as outer layers of the laminate, such as the tape 166 shown in phantom in FIG. 23. A composite laminate panel 164 can also include a core 160 similar to the sandwich panel 158 resulting in the construction shown in FIG. 24. Such a solid laminate panel 164 will also have layers of weak material 165 or tape 166 disposed in the laminate as either inner layers or outer layers as described above. (The layer of weak material 165 or tape 166 is omitted for clarity).

The layer of material 165 of a solid laminate panel 164 should provide minimal bending strength across a weakened portion 155 of the panel 164. For this purpose, a fine layer of mat fiberglass material can be used. A layer having a nominal axial strength of about 100 to 200 lbs./in. would be adequate for this specific embodiment.

Figure 25:
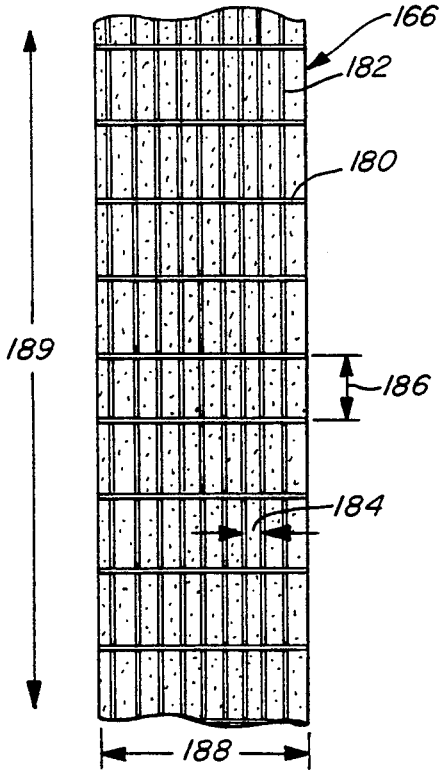
FIG. 25 is a plan view of fiber tape as used in a solid laminate panel.

A layer of tape having a weave could also be used where the width would span the cut 162 of the weakened portion 155 and be placed along the weakened portion 155 between any intersections 167 (FIG. 19A) of cuts. As illustrated in FIG. 25, the tape 166 is a weave made of horizontal strands 180 and vertical strands 182. The weave has a width spacing 184 and length spacing 186 and is chosen to provide sufficient reinforcement across a weakened portion 155 for the axial and shear stresses resulting in the shell from jet wind loads, while breaking cleanly under the 700 ft./lb impact load. Commercially available tapes are suitable to this application. The tape style, an industry standard, can be chosen such that the breakage strength along its width 188 is about 100 to 200 lbs./in., for this embodiment. The tape can have an unbalanced strength along its length 189. The width of the tape should span the weakened portion 155 and the tape should be cut at each intersection 167 (FIG. 19) of weakened portions 155 as described above. Testing has also shown that a tape layer as the outer layers of the panel has a small advantage in strength over the other construction.

Typical finishing layers can also be provided for the panel, to provide a good appearance. A hydrophobic coating should also be used on antenna window panels because water absorbs radar signals.

The number of layers of material used to form panel is dependent upon many variables such as the size of the panel, its location in the enclosure and whether it is an antenna window. The strength characteristics of the materials as well as the modulus of the resin used in the laminate also need to be considered. For example, panel sections bolted to the support plate 132 (see FIG. 18) of the tower 60 will have more layers of material and possibly a heavier and stronger core. The stresses in a panel decrease with distance from a support point and the panel thickness can be tapered to reflect this decrease. Weakened portions 155 are provided within a diameter of the maximum breakage dimension at the support points to comply with the maximum size of breakage allowed. As another example, antenna window panels, such as panel 116 of FIG. 10, will have a thickness that depends on the frequency of the antenna. Given the dielectric constants of the materials, the thickness, i.e. number of layers of material, should be determined so that the panel does not hinder the proper operation of the antenna. The panel is tuned to the quarter or half-wave length.

In order to verify that a particular construction for a panel of the present invention meets its application requirements, a structural analysis can be performed. The strength properties needed to meet the distribution load resistance requirement can be found through finite element analysis. The finite element model can be based on the pressure distribution for a cylinder in the case of both a cylindrical or double-curvature shell. The dynamic pressure of the maximum distributed load, the deadweight loading, and the drag coefficient of the enclosure need to be considered in this model. The proposed construction of the shell panels is used to construct the mode for the analysis. Given the known properties of the materials, this analysis will verify whether the proposed construction can resist a potential distributed load on the shell.

Given a preferred embodiment for an azimuth antenna enclosure, made of solid laminate panels having a thickness of 0.13 inch, but 0.26 inch in the vicinity of the supports, and an antenna window sandwich panel with 0.020" face skins with a ½" thick foam core, the maximum stresses were found to be 6000 psi in the area of the supports. The ultimate strength of the solid laminate panels and the sandwich panel are respectively 18,000 psi and 25,000 psi. Surely, this construction was sufficient for the desired distributed load. Verification that face skin wrinkling will not occur was also be performed.

To verify the design of the weakened portions, stress analysis and testing were performed. A panel having weakened portions of intervals of two feet functioned properly. For other enclosures some experimentation may be necessary to find optimal intervals for weakened portions.

Figure 26:
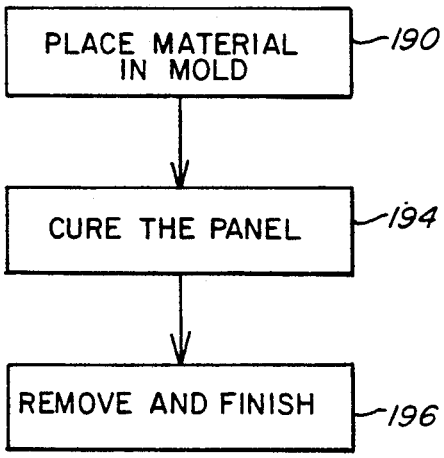
Fig. 26 (PRIOR ART)
FIG. 26 is a flowchart of the standard method for fabricating laminate panels.
Figure 27:
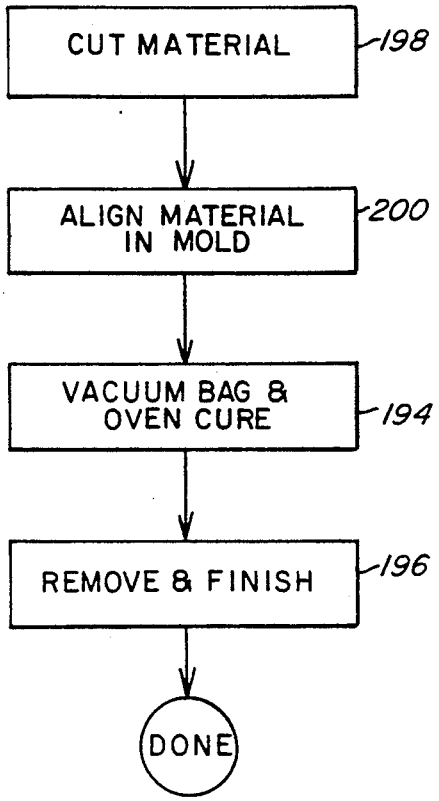
FIG. 27 is a flowchart for fabricating a sandwich panel.

The fabrication of the panels for the frangible enclosure will now be described in connection with FIGS. 26 through 28. The typical method for making laminate panels, illustrated in FIG. 26, involves placing material (step 190) in a mold, then curing the panel (step 194). The step 194 of curing the panel includes a well known process for curing composite laminates using a vacuum bag process and oven cure. In this process, resin forms a matrix for the reinforcing fabric material. The material can be pre impregnated with which resin is placed in the mold during lay-up. Pre impregnated material is preferable because of its more controlled resin to material ratio. After a panel has been cured, it is removed from the mold and then finished, (step 196). This step 196 of finishing can include applying a hydrophobic coating to the external surface of the panel, and a finish coating, such as polyurethane, to the internal surface of the panel.

The step 194 of curing the panels can also be performed using an autoclave process or post bonding of sandwich skins to a core under pressure.

A frangible sandwich panel (such as panel 158 of FIGS. 20 and 21) is constructed according to the process described in connection with FIG. 27. Similar reference numbers among FIGS. 26 through 28 depict similar steps. With a sandwich panel 158, the material is preferably pre-cut (step 198), forming slits 157 for the weakened portions 155 in the material. When the material is aligned in the mold (step 200) pressure is applied using a vacuum bag process, and the panel is oven cured (step 194), then finished (step 196). It is possible to perforate the panel by drilling after curing followed by back-filling the drilled holes with resin.

Figure 28:
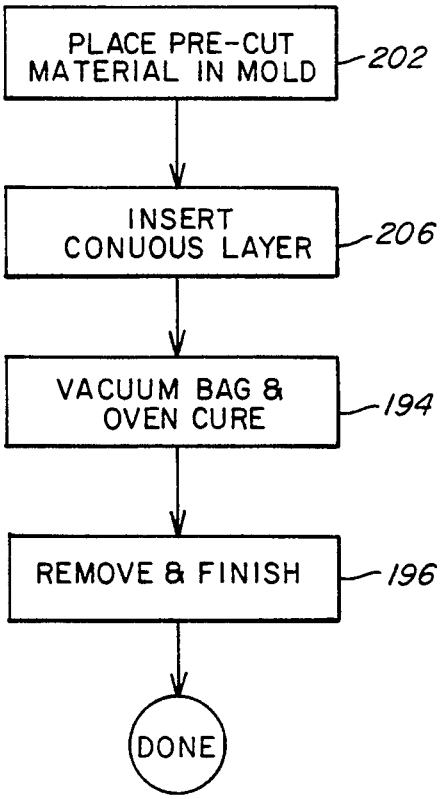
FIG. 28 is a flowchart for fabricating a solid laminate panel.
Figure 29:
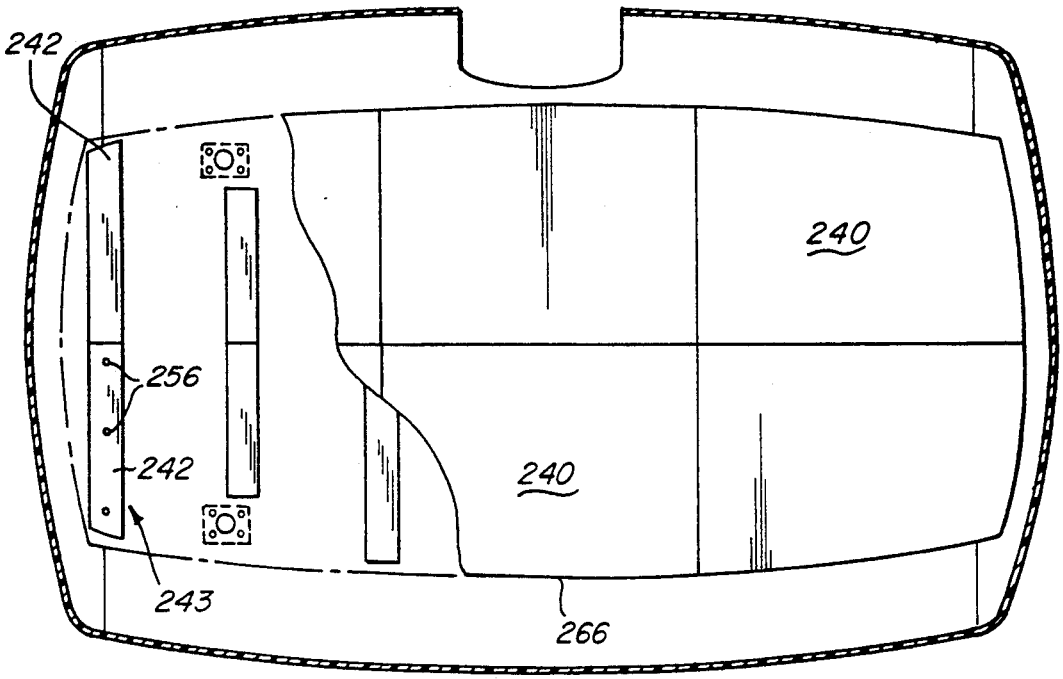
FIG. 29 is a cut away, floor plan of an enclosure for an azimuth antenna.

A solid laminate panel (such as panels 164 of FIGS. 22 through 24) is formed in a similar manner, as illustrated in the flowchart of FIG. 28. First the precut material is placed in the mold (step 202). A continuous layer 165, or piece of tape 166, is inserted in the layers (step 206) to provide material continuity of the panel. Once all the material is placed in the mold, the panel is cured (step 194), then finished (step 196).

Having now described the shell design, a description of the frangible floor system 66 will now be given in connection with FIGS. 29 through 34.

The floor system 66 is designed as an assembly of separate lightweight components that need only be loosely linked to each other. This system need only be loosely connected to the inside surface of the enclosure, as well. Together, the assembly of components forms a system sufficient to support the primarily vertical loads of personnel and equipment that will occupy the enclosure, but one that will break up easily into separate parts under the generally horizontal impact loads.

Figure 30:
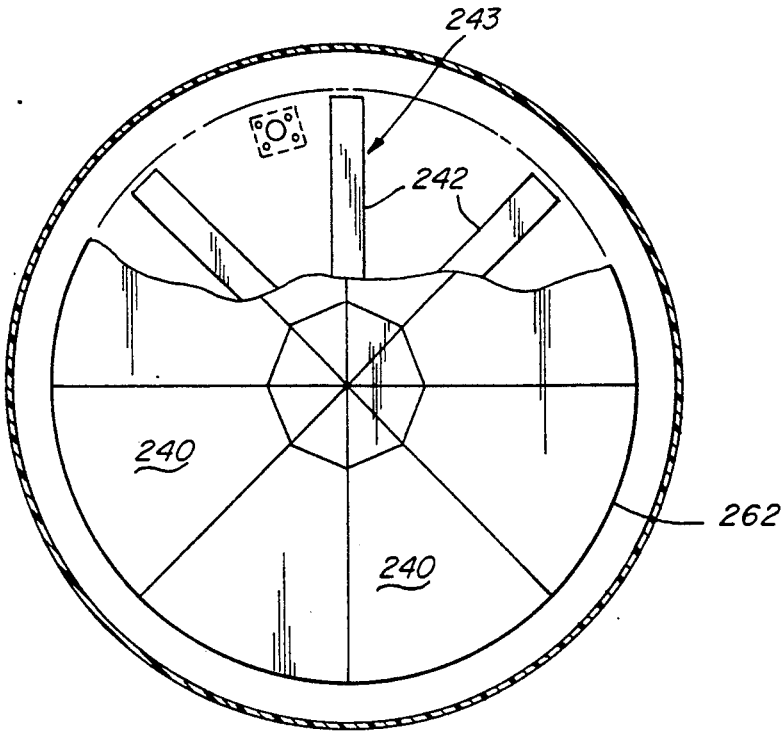
FIG. 30 is a cut away, floor plan of an enclosure for an elevation antenna.

One embodiment of the floor system shown in FIGS. 29 through 32 comprises a set of thin floor panels 240 resting on light support members 242. The support members are combined into sets, each set forming a support element 243. The support elements 243 are separated by at most the width of a floor panel 240. Alternatively, the support elements 243 can form a star configuration as shown in FIG. 30. The support members 242, are preferably made of low density, light weight (see attached) rigid foam. The support members 242 also have holes 256 which engage with pins.

Figure 31A:
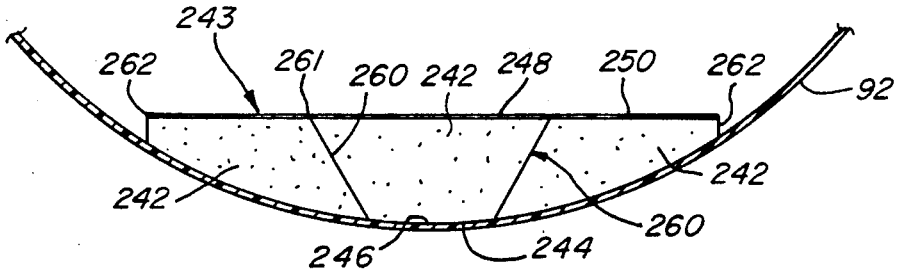
FIG. 31A–B are front cross sectional views of the floor system intact (A) and after impact (B)
Figure 31B:
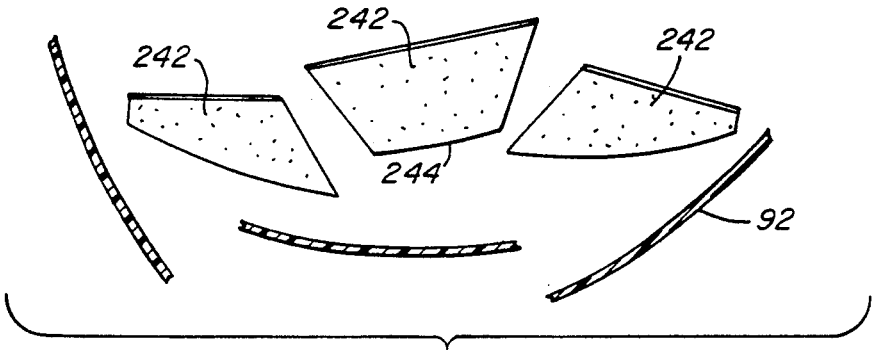

The construction of the support members can be understood more clearly in connection with FIG. 31. For a double-curvature azimuth antenna enclosure, support members 242 are curved on their undersides 244 (see FIG. 31A), and rest directly on the concave surface 246 of the bottom 92 of the enclosure 90. Similarly, for elevation antenna enclosures 110 (of FIG. 6) the support members 242 the rest on the bottom 112 of the enclosure. The support members 242 can be loosely connected to the surface of the bottom of the enclosure using sections of double-faced tape, or possibly a small bracket attached to the base panel. A thin sheet of laminate material 248 (drawn out of scale for the sake of clarity), which is similar to the laminate material of the panel construction is bonded to the top surface 250 of each support element 243 to protect the foam from powdering due to contact with the panels 240. The laminate also connects the foam support members 22 to form the support elements 243 and is provided with a weakened portion 261 at the joining portions 260 of adjacent support members. The support members 242 also have a maximum dimension less than the predetermined fixed breakage size (e.g. four feet). The edges 260 of adjacent blocks are preferably tapered or beveled to help them pick up and over each other upon impact as shown in FIG. 31B.

Figure 32A:
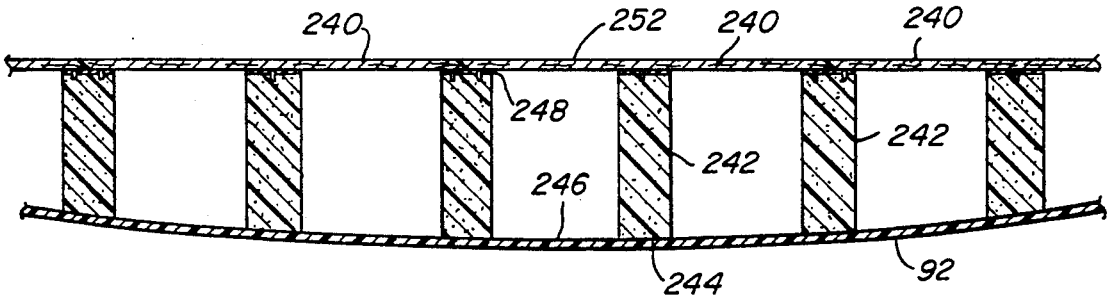
FIGS. 32A—B are side cross-sectional views of the floor system intact (A) and after impact (B)
Figure 32B:
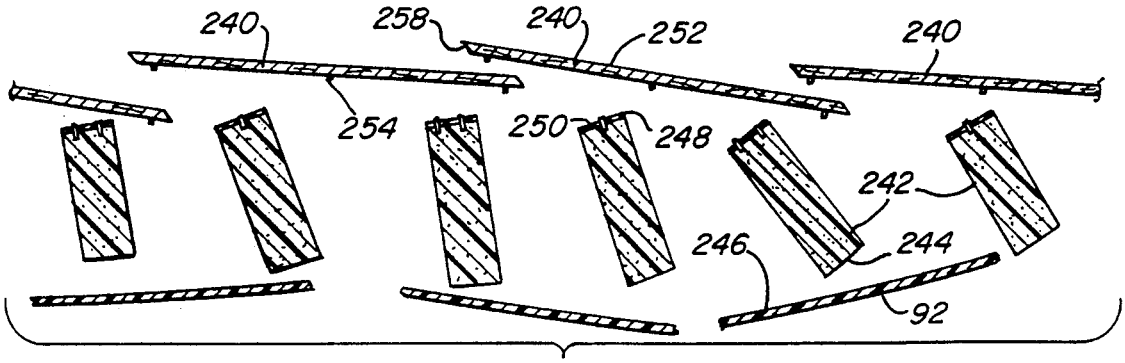

Referring now to FIG. 32A, the floor panels 240, also having a maximum dimension of at most the predetermined fixed breakage size, are preferably constructed of plywood with a non skid flooring (not shown) bonded to the upper face 252 of the panel. Short shear pins 254 (see FIG. 32B) on the underside of the floor panels 240 engage the holes 256 in the support numbers 242 to locate and stabilize those members relative to the panels 240. The edges 258 of adjacent panels are preferably beveled to facilitate the panels kicking up and over each other if struck edge-on as shown in FIG. 32B. Lengths of flexible gasket (not shown) optionally can also be attached at the outer edges 262 of the floor panels, seated against the wall of the enclosure, to form a seal between the wall and the floor 66. Such a gasket is similar to standard precast baseboard moldings such as used in homes. The gasket should also be placed in sections having a maximum dimension of four feet.

Figure 33:
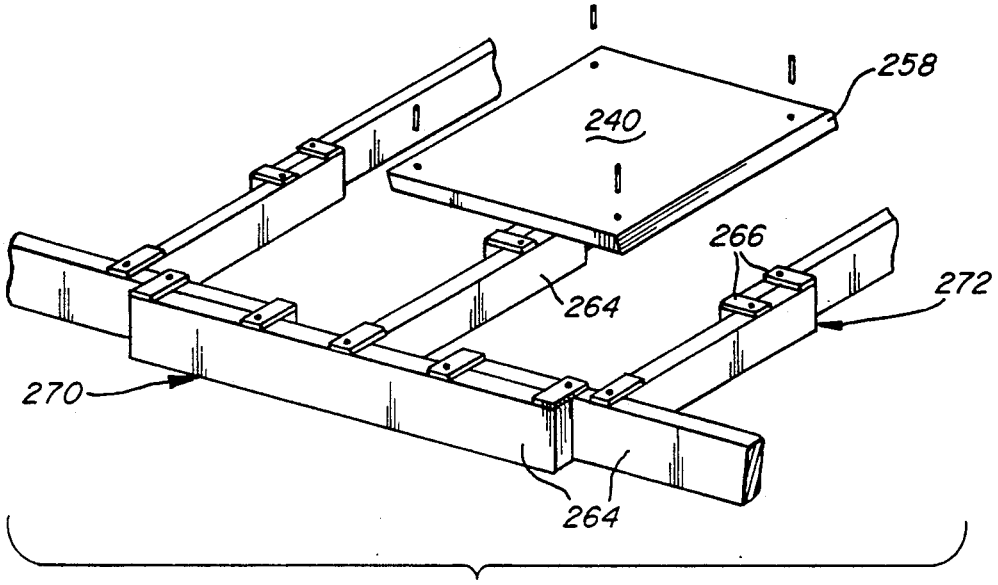
FIG. 33 is an isometric exploded view of an alternate embodiment of the floor system.
Figure 34:
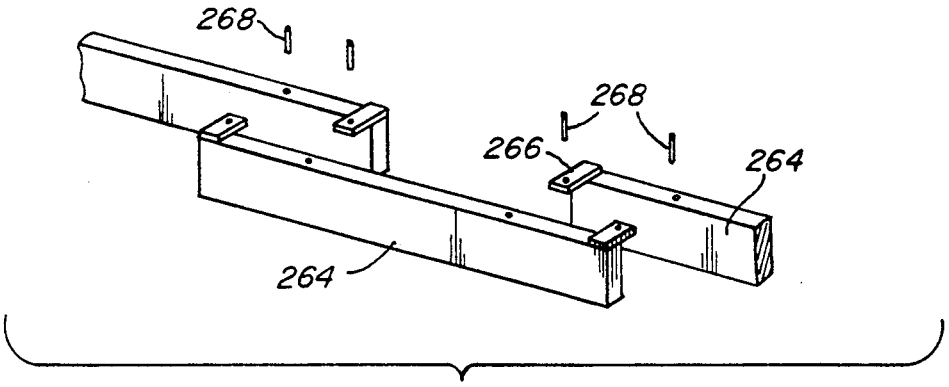
FIG. 34 is an isometric exploded view of the support beams of the alternate floor system.

An alternate embodiment of the floor system 66 will now be discussed in connection with FIGS. 33 and 34. In this embodiment, the floor panels are substantially the same as those in the first embodiment. The support structure shown in FIG. 33 is different in that it comprises a plurality of beams 264, preferably made of aluminum, interconnected with connection plates 266 and shear pins 268 (FIG. 34). A girder 270, formed along one direction, is connected to the support stubs 134 (not shown) of the tower 60, preferably using shear pins as well. The girder, in turn, supports transverse support beams 272 which extend across the enclosure and, in turn, support the floor panels 240. The floor panels 240 need only be loosely connected to the supporting structure of beams 270 and 272. Upon a generally horizontal impact, the shear pins 268 will break, thus causing failure of the support system and collapse of the floor. However, generally vertical loads of personnel and equipment will be supported by this structure.

Figure 35:
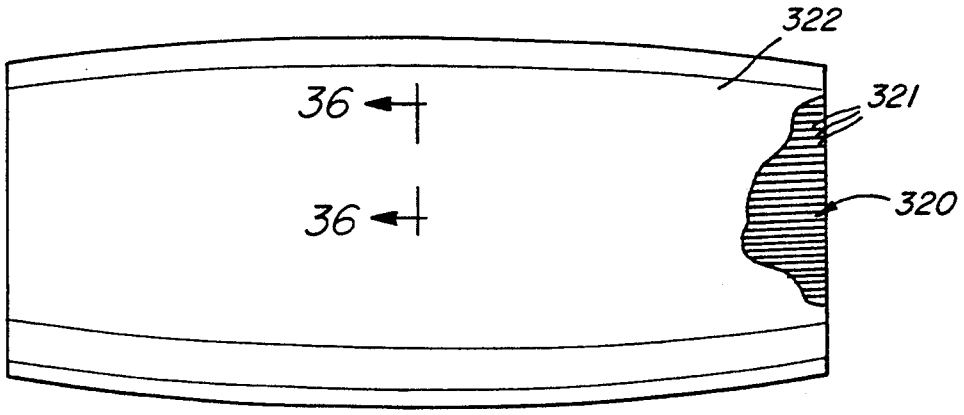
FIG. 35 is a plan, cut away view of a panel having de-icing wire embedded therein.
Figure 36:
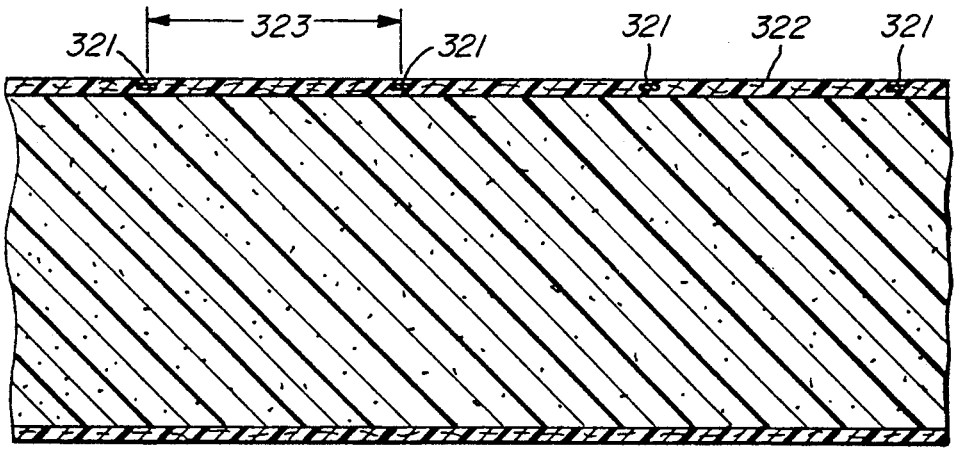
FIG. 36 is a cross section of a panel taken along line 36—36 of FIG. 35 indicating the location of anti-icing wires.

If the frangible enclosure of the present invention is used in conjunction with an antenna, the antenna window needs to incorporate an ice prevention system, as illustrated in FIGS. 35 and 36, because ice absorbs radar signals. Standard ice prevention systems can be used in which an electrical heating grid 320, maintains the temperature of the panel at a certain temperature. The grid comprises resistive wire 321 laminated within the outer skin 322 of the panel. For the azimuth antenna enclosure, the wires will be oriented horizontally as shown; for an elevation antenna enclosure the wires 321 will be oriented vertically.

For a frangible enclosure, a rectangular ribbon 321 was selected over a round wire to optimize frangibility. This selection provides little reduction in surface area, minimally affecting heat transfer, whereas the strength of the element is reduced significantly, improving frangibility.

In addition to selecting a small ribbon, the material of the resistive wire 321 was selected to be a copper nickel alloy. (CuNi) as opposed to the more conventional NiCr ribbon.

Admittedly, CuNi has lower resistance, so more current is reguired to achieve the same watt density. However, this slight disadvantage is more than offset by the nearly 2 to 1 reduction in tensile strength of the CuNi versus the NiCr. The ultimate strength of annealed 45 Ni/55 Cu alloy is 60 KSI whereas common NiCr 60 is 105 KSI. Their respective resistivities are 50 $\mu\Omega$/cm and 112 $\mu\Omega$/cm. The CuNi has an additional advantage, with regard to manufacturing, because it can be soldered. NiCr is not easily soldered and for this application would require mechanically fastened joints.

The spacing 323 (FIG. 36) and the size of the ribbon 321 need to be selected according to both thermal requirements and antenna performance. Thermal and electromagnetic analyses can be performed on the enclosure to determine the parameters necessary for efficient de icing capability, with uncompromised antenna performance and frangibility. For this embodiment, a spacing of 0.375 inches was found to be adequate to maintain a surface temperature of 38° F. enclosure surface temperature while maintaining the surface temperature of the heating wires at less than 150° F.

Electromagnetic requirements, including the operating frequency, polarization, scan, insertion loss, beam width change, cross polarization level, scattering and boresight shift of the antenna can be analysed in view of the wire size, and spacing.

Given the preferred embodiment of an enclosure of sandwich panels having 0.020 inch face skins 323 with a 0.50 inch foam core and 0.016 inch wide, 0.0002 thick wires 321 spaced 0.375 inches apart, such electromagnetic analyses were performed. The analyses demonstrated that the de-icing wire construction and spacing 323 combined with the panel construction of the preferred embodiment is compatible with the electromagnetic requirements for the azimuth antenna enclosure.

Having now described the preferred embodiment of the invention, it should be apparent to those skilled in the art that the foregoing is illustrative only and not limiting, having been presented by way of example only. Numerous variations of a double-curvature shape are possible including spheres, cylinders with spherical ends, etc. Thus, numerous other embodiments and modifications thereof are contemplated as falling within the scope of the present invention as defined by the appended claims and equivalents thereto.

What is claimed is:

1. A frangible enclosure comprising:

a plurality of panels, means for interconnecting said panels to form a housing, said housing having a curvature whereby distributed loads primarily are resisted by axial stresses in the housing, at least one of said panels having means forming a weakened portion therein, for reducing resistance thereat to flexural loads, whereby said enclosure, when subjected to a large impact load, breaks apart proximate said at least one means forming a weakened portion into a plurality of pieces, each piece having a maximum dimension less than a predetermined fixed size;

wherein at least one of said plurality of panels comprises:

a first layer of material;

said at least one means forming a weakened portion being formed in the first layer;

said first layer of material formed into a laminate having a curvature according to the curvature of the housing;

wherein said at least one means forming a weakened portion comprises at least one perforated portion formed in the first layer of the panel;

wherein said at least one means forming a weakened portion defines a plurality of breakage sections in the panel, each section having a dimension of at most the fixed size;

wherein the panel further comprises at least one second layer of material having low bending strength;

wherein the first layer of material comprises at least one layer of fiber-reinforced material;

wherein said at least one second layer of material comprises at least one layer of foam core; and wherein at least one panel further comprises means for preventing the formation of ice upon the panel including an electrical heating grid having a plurality of flat heating wires, said wires being constructed of a copper-nickel alloy.

2. A frangible enclosure comprising:

a plurality of panels, means for interconnecting said panels to form a housing, said housing having a curvature whereby distributed loads primarily are resisted by axial stresses in the housing, at least one of said panels having means forming a weakened portion therein, for reducing resistance thereat to flexural loads, whereby said enclosure, when subjected to a large impact load, breaks apart proximate said at least one means forming a weakened portion into a plurality of pieces, each piece having a maximum dimension less than a predetermined fixed size;

wherein at least one of said plurality of panels comprises:

a first layer of material;

said at least one means forming a weakened portion being formed in the first layer;

said first layer of material formed into a laminate having a curvature according to the curvature of the housing;

wherein said at least one means forming a weakened portion comprises at least one cut portion separating the first layer of material into a plurality of sections, and further including a second layer of material stacked contiguously with the first layer and spanning said at least one cut portion.

3. A frangible enclosure as set forth in claim 2, wherein said at least one means forming a weakened portion defines a plurality of breakage sections in the panel, each section having a dimension of at most the fixed size.

4. A panel as set forth in claim 3, wherein the first layer of material comprises a plurality of layers of material, and said at least one second layer is disposed between two layers of material in the first layer.

5. A panel as set forth in claim 4 wherein said at least one second layer comprises two layers of material each disposed on opposite sides of the first layer.

6. A panel as set forth in claim 5, wherein said at least one second layer of material comprises fiber tape.

7. A panel as set forth in claim 6, wherein said at least one second layer of material comprises a layer of fiber-reinforced material having low bending strength.

8. A panel as set forth in claim 7, wherein said at least one means forming a weakened portion defines a plurality of breakage sections in the panel, each section having a dimension-of at most the fixed size.

9. A panel as set forth in claim 8, further comprising at least one third layer of material having low bending strength.

10. A panel as set forth in claim 9, wherein the first layer of material comprises at least one layer of fiber reinforced material.

11. A frangible enclosure as set forth in claim 10, wherein said at least one third layer of material comprises at least one layer of foam core.

12. A frangible enclosure as set forth in claim 11, wherein at least one panel further comprises means for preventing the formation of ice upon the panel including an electrical heating grid having a plurality of flat heating wires, said wires being constructed of a copper-nickel alloy.

13. A frangible enclosure comprising:

a plurality of panels, means for interconnecting said panels to form a housing, said housing having a curvature whereby distributed loads primarily are resisted by axial stresses in the housing, at least one of said panels having means forming a weakened portion therein, for reducing resistance thereat to flexural loads, whereby said enclosure, when subjected to a large impact load, breaks apart proximate said at least one means forming a weakened portion into a plurality of pieces, each piece having a maximum dimension less than a predetermined fixed size; and a floor system disposed within said enclosure.

* * * * *